US007650925B2

(12) United States Patent
Nikolovski et al.

(10) Patent No.: US 7,650,925 B2
(45) Date of Patent: Jan. 26, 2010

(54) IDENTIFYING AND REDUCING CAUSES OF DEFECTS IN THIN CAST STRIP

(75) Inventors: Nikolco Nikolovski, Figtree (AU); Peter Woodberry, Austinmer (AU)

(73) Assignee: Nucor Corporation, Charlotte, NC (US)

( * ) Notice: Subject to any disclaimer, the term of this patent is extended or adjusted under 35 U.S.C. 154(b) by 515 days.

(21) Appl. No.: 11/467,652

(22) Filed: Aug. 28, 2006

(65) Prior Publication Data

US 2008/0047681 A1 Feb. 28, 2008

(51) Int. Cl.
*B22D 11/06* (2006.01)
*B22D 11/16* (2006.01)

(52) U.S. Cl. ..... 164/480; 164/428; 164/452; 164/154.8

(58) Field of Classification Search ..... 164/480, 164/428, 451, 452, 154.8
See application file for complete search history.

(56) References Cited

U.S. PATENT DOCUMENTS

| | | | |
|---|---|---|---|
| 4,222,254 | A | 9/1980 | King, Jr. et al. |
| 4,678,023 | A | 7/1987 | Knapp et al. |
| 4,702,300 | A | 10/1987 | Nakanori et al. |
| 4,850,211 | A | 7/1989 | Sekiguchi et al. |
| 4,910,985 | A | 3/1990 | Ballyns |
| 5,031,688 | A | 7/1991 | Burgo et al. |
| 5,203,188 | A | 4/1993 | Osgood et al. |
| 5,224,535 | A | 7/1993 | Charpentier |
| 5,706,882 | A | 1/1998 | Fellus et al. |
| 5,927,375 | A | 7/1999 | Damasse et al. |
| 6,167,943 | B1 | 1/2001 | Fish et al. |
| 6,474,403 | B1 | 11/2002 | Nikolovski et al. |
| 6,536,506 | B2 | 3/2003 | Nikolovski |
| 6,604,569 | B2 | 8/2003 | Nikolovski et al. |
| 6,988,530 | B2 | 1/2006 | Nikolovski |
| 7,156,151 | B2 | 1/2007 | Mahapatra et al. |
| 2007/0034349 | A1 | 2/2007 | Savariego |

FOREIGN PATENT DOCUMENTS

| | | |
|---|---|---|
| EP | 1 172 161 | 1/2002 |
| JP | 63-137548 | 6/1988 |

(Continued)

OTHER PUBLICATIONS

EP Search Report for AU 2007901173 dated Mar. 23, 2007.

(Continued)

*Primary Examiner*—Kevin P Kerns
(74) *Attorney, Agent, or Firm*—Hahn Loeser & Parks LLP; Arland T. Stein

(57) ABSTRACT

The method of producing thin cast strip by continuous casting is disclosed. At least two sensors are operationally connected to at least one end of at least one of a pair of casting rolls or of a pair of brushes, to continuously measure at least two force-related parameters during casting. At least two time domain signals corresponding to the measured force-related parameters are generated. The time domain signals are continuously monitored and transformed into corresponding frequency domain spectrums. The frequency domain spectrums are analyzed and composite intensity values are continuously calculated from the intensity levels of at least a portion of the frequency component signals within the frequency spectrums. Casting parameters are adjusted in response to reduce strip defects.

102 Claims, 24 Drawing Sheets

FOREIGN PATENT DOCUMENTS

| | | |
|---|---|---|
| JP | 11-090587 | 4/1999 |
| JP | 2001 058245 | 3/2001 |
| JP | 2003-154441 | 5/2003 |
| JP | 2005-046884 | 2/2005 |
| KR | 20040003296 | 1/2004 |
| KR | 20040003297 | 1/2004 |
| KR | 2004020470 | 3/2004 |
| KR | 20020051995 | 7/2007 |
| WO | 98/28452 | 7/1998 |
| WO | 99/33595 | 7/1999 |

OTHER PUBLICATIONS

ISR for AU 2006905240 dated Oct. 16, 2006.
PCTAU2007001192 International Search Report.
PCTAU2007001192 Written Opinion.

IDENTIFYING AND REDUCING CAUSES OF DEFECTS IN THIN CAST STRIP

BACKGROUND OF THE INVENTION

In the continuous casting method of manufacturing steel, molten metal is cast directly into thin strip by a casting machine. The shape of the thin cast strip is determined by the mold of the casting rolls used in the machine. The cast strip may be subjected to cooling and processing upon exit from the casting rolls.

In a twin roll caster, molten metal is introduced between a pair of counter-rotated laterally positioned casting rolls which are internally cooled, so that metal shells solidify on the moving casting roll surfaces and are brought together at the nip between the casting rolls to produce a thin cast strip product delivered downwardly from the nip between the casting rolls. The term "nip" is used herein to refer to the general region at which the casting rolls are closest together. The molten metal may be poured from a ladle through a metal delivery system comprised of a tundish and a core nozzle located above the nip, to form a casting pool of molten metal supported on the casting surfaces of the rolls above the nip and extending along the length of the nip. This casting pool is usually confined between refractory side plates or dams held in sliding engagement with the end surfaces of the casting rolls so as to restrain the two ends of the casting pool.

Typically, one of the casting rolls is mounted in fixed journals, and the other casting roll is rotatably mounted on supports that can move against the action of a biasing force to enable the roll to move laterally to accommodate fluctuations in casting roll separation and strip thickness. The biasing force may be provided by helical compression springs or alternatively, may comprise a pair of pressure fluid cylinder units.

A strip caster with spring biasing of the laterally movement of one casting roll relative to another casting roll is disclosed in U.S. Pat. No. 6,167,943 to Fish et al. In that apparatus, the biasing springs act between the roll carriers and a pair of thrust reaction structures, the positions of which can be set by operation of a pair of powered mechanical jacks to enable the initial compression of the springs to be adjusted to set initial compression forces which are equal at both ends of the casting roll. The positions of the roll carriers need to be set and subsequently adjusted after commencement of casting, so that the gap between the rolls is maintained across the width of the nip in order to produce a strip of stable profile. However, as casting continues, the profile of the strip will inevitably vary due to eccentricities in the rolls and dynamic changes due to variable heat expansion and other dynamic effects.

Eccentricities in the casting rolls can lead to strip thickness variations along the strip length. Such eccentricities can arise either due to machining and assembly of the casting rolls, or due to distortion of the hot casting rolls during the casting campaign due to non-uniform heat flux distribution. Specifically, each revolution of the casting rolls will produce a pattern of thickness variations dependent on eccentricities in the casting rolls, and this pattern in the strip will be repeated with each revolution of the casting rolls. Such repeating pattern periodically with roll rotation will be sinusoidal, but there are secondary or other vibrational fluctuations which are not of sinusoidal patterns directly related to the rotation speed of the casting rolls.

With improvements in the design of the casting rolls for a twin roll caster, particularly by the provision of textured surfaces which enable control of the heat flux at the interface between the casting rolls and the casting pool, it has been possible to achieve dramatic increases in strip casting speeds. However, with casting of thin strip at higher casting speeds, there has been an increased tendency to produce both high frequency and low frequency vibrations in the system that can affect the quality of the cast strip.

The high frequency variations or defects in the cast steel strip may be due to high-frequency chatter, medium frequency chatter, and brush-derived chatter in the twin caster assembly. The low frequency gauge variations may be defects known as herringbone (a type of strip defect that manifests itself at specific low frequencies), white lines (another type of defect at low frequencies), and twice-per-roll revolution related force fluctuations, which may also be due to unwanted low frequency vibrations in the caster assembly. Other types of defects have also been observed.

U.S. Pat. No. 6,604,569 to Nikolovski et al. describes how varying the speed of rotation of the caster rolls can be performed to reduce, if not eliminate, certain variations in the cast steel strip. For example, the repeated thickness variations from eccentricities in the casting rolls can be reduced by imposing a pattern of speed variations in the speed of rotation of the rolls. Compensation in this manner is possible because even small speed variations in casting speed can be effective. The Nikolovski patent relies on measurement of the thickness of the steel strip after it is produced to determine what the compensation in the speed of the rolls should be for variations in strip thickness with roll eccentricity. However, measurement of the thickness of the thin cast steel strip is not a direct indication of what is happening at the casting rolls, and does not compensate for the high frequency and low frequency vibration that may be occurring in the thin cast steel strip system.

U.S. Pat. No. 5,927,375 to Damasse et al. describes measuring the roll separating force at the casting rolls of a twin roll casting system, and observing at periodic harmonic frequencies associated with rotation of the casting rolls. The Damasse device controls for casting roll eccentricity due to casting roll shape, and nothing else. Damasse et al. does not measure or correct strip profile eccentricities unrelated to casting roll eccentricity and roll rotation, Strip profile defects can be unrelated to casting roll shape and roll rotation, which can occur because the heat flux on each casting roll can change and for other dynamics and vibrations encountered by the caster system.

Identifying and correcting the various defects that can occur in the thin cast strip profile, and to do that in real time during the casting campaign, would be beneficial in providing quantity strip. The accurate varying in real time of the roll separation gap, generally on the order of a few millimeters or less, to define an appropriate separation of the casting rolls at the nip in response to identified strip defects is needed. Adjusting the gap between the casting rolls by adjusting the biasing force against which the casting rolls move during the casting campaign also accommodates for fluctuations in strip thickness, notably during start up. In addition, adjusting casting speed and casting pool height in real time in response to identified strip defects could improve the quality of the thin cast strip.

SUMMARY OF THE INVENTION

A method of producing thin cast strip by continuous casting is disclosed that comprises:

a) assembling a pair of casting rolls having a nip therebetween, with side dams adjacent the ends of the nip capable of confining a casting pool of molten metal supported on casting surfaces of the casting rolls;

b) operationally connecting at least two sensors to at least one end of the pair of casting rolls to continuously generate from the sensors at least two time domain signals representative of force-related parameters measured by the sensors;

c) introducing molten steel between the pair of casting rolls to form a casting pool supported on casting surfaces of the casting rolls confined by the side dams;

d) counter-rotating the casting rolls to form solidified metal shells on the casting surfaces of the casting rolls and cast thin steel strip through the nip between the casting rolls from the solidified shells;

e) continuously receiving the time domain signals at a processor-based platform;

f) transforming each of the time domain signals into a frequency domain spectrum; and g) continually calculating a composite intensity value for a given frequency range from the intensity levels of frequency component signals that are present within the given frequency range.

The method enables causes of variability and defects in thin cast metal strip to be reduced during a casting process to improve strip quality.

The method may comprise operationally connecting sensors to both ends of each casting roll of the pair of casting rolls, and continuously generating from each sensor time domain signals being representative of the force-related parameters at both ends of each casting roll. The method may thus further include continuously operationally measuring first and second force-related parameters at one end of the casting rolls of the twin roll caster system, and also third and fourth force-related parameters at the opposite end of the casting rolls of the twin roll caster system, to generate a first time domain signal, a second time domain signal, a third time domain signal and a fourth time domain signal, respectively. The method also includes transforming the first time domain signal into a first frequency domain spectrum, the second time domain signal into a second frequency domain spectrum, the third time domain signal into a third frequency domain spectrum, and the fourth time domain signal into a fourth frequency domain spectrum. The method further includes continually calculating for a given frequency range a composite intensity value from the intensity levels of the frequency component signals that are present within the given frequency range. The calculation of composite intensity values may be for several given frequency ranges from the frequency domain spectrums.

The frequency component signals may be displayed on a monitor to an operator, and adjustments may be made by the operator to the casting roll gap separation force, the casting pool height, and/or the casting speed in response to continually calculating composite intensity values from a given range of frequency component signals within a given frequency range form the frequency domain spectrum. This may be done, for example, by calculating the composite intensity values for low frequency range, e.g., below 14 Hz, medium (intermediate) frequency range, e.g. between 14 and 52 Hz, and high frequency range, e.g., above 52 Hz, to allow the operator to monitor the composite intensity levels within each of these frequency ranges. Alternatively a computer program can be provided to automatically cause of defects in the thin cast strip.

Additionally or alternatively, also disclosed is a method to reduce the causes of variability and defects in thin cast metal strip during a continuous casting process using first and second casting rolls, and first and second casting roll brushes positioned to clean the casting surfaces of the casting rolls. The method includes operationally connecting at least two sensors to at least one end of the first and second casting roll brushes, and continuously generating, from the sensors, at least two time domain signals representative of at least two force-related parameters measured by the sensors. The method includes continuously measuring a first force-related parameter at one end of the first casting roll brush and a second force-related parameter at the same end of the second casting roll brush of the twin roll caster system, to generate a first time domain signal and a second domain signal, respectively. The method may, but does not necessarily include further continuously measuring a third force-related parameter at the other end of the first casting roll brush and a fourth force-related parameter at the same other end of the second casting roll brush, to generate a third time domain signal and a fourth time domain signal, respectively. The method also includes transforming the first time domain signal into a first frequency domain spectrum and the second time domain signal into a second frequency domain spectrum, and if generated, the third time domain signal into a third frequency domain spectrum and the fourth time domain signal into a fourth frequency domain spectrum. The method further includes analyzing each of the two or four frequency domain spectrums to identify for at least one given frequency range a composite intensity value from frequency component signals present within the given frequency range from the frequency domain spectrums. The calculation of composite intensity levels may be for several given frequency ranges from the frequency domain spectrums.

The frequency component signals may be displayed on a monitor to an operator, and adjustments may be made by the operator to the speed of rotation of the casting roll brushes and/or the force exerted by the casting roll brushes on the casting surfaces of the casting rolls in response to continuously calculating for a given frequency range a composite intensity value from the intensity levels of the identified frequency component signals for the given frequency range. This may be done by dividing the identified frequency domain spectrum into low frequency signals, e.g., below 14 Hz, medium range signals, e.g. between 14 and 52 Hz, and high frequency signals, e.g., above 52 Hz, so that the operator can monitor the composite intensity values for each of these given frequency range. Alternatively, a computer program can be provided to automatically adjust the speed of rotation of the casting roll brushes and/or the pressure exerted by the casting roll brushes on the casting surfaces of the casting rolls according to a predetermined schedule of priorities to correct for the identified causes of defects in the thin cast strip.

These and other advantages and novel features of the present invention, as well as details of an illustrated embodiment thereof, will be more fully understood from the following description and drawings.

DETAILED DESCRIPTION OF DRAWINGS

Figure 1A:
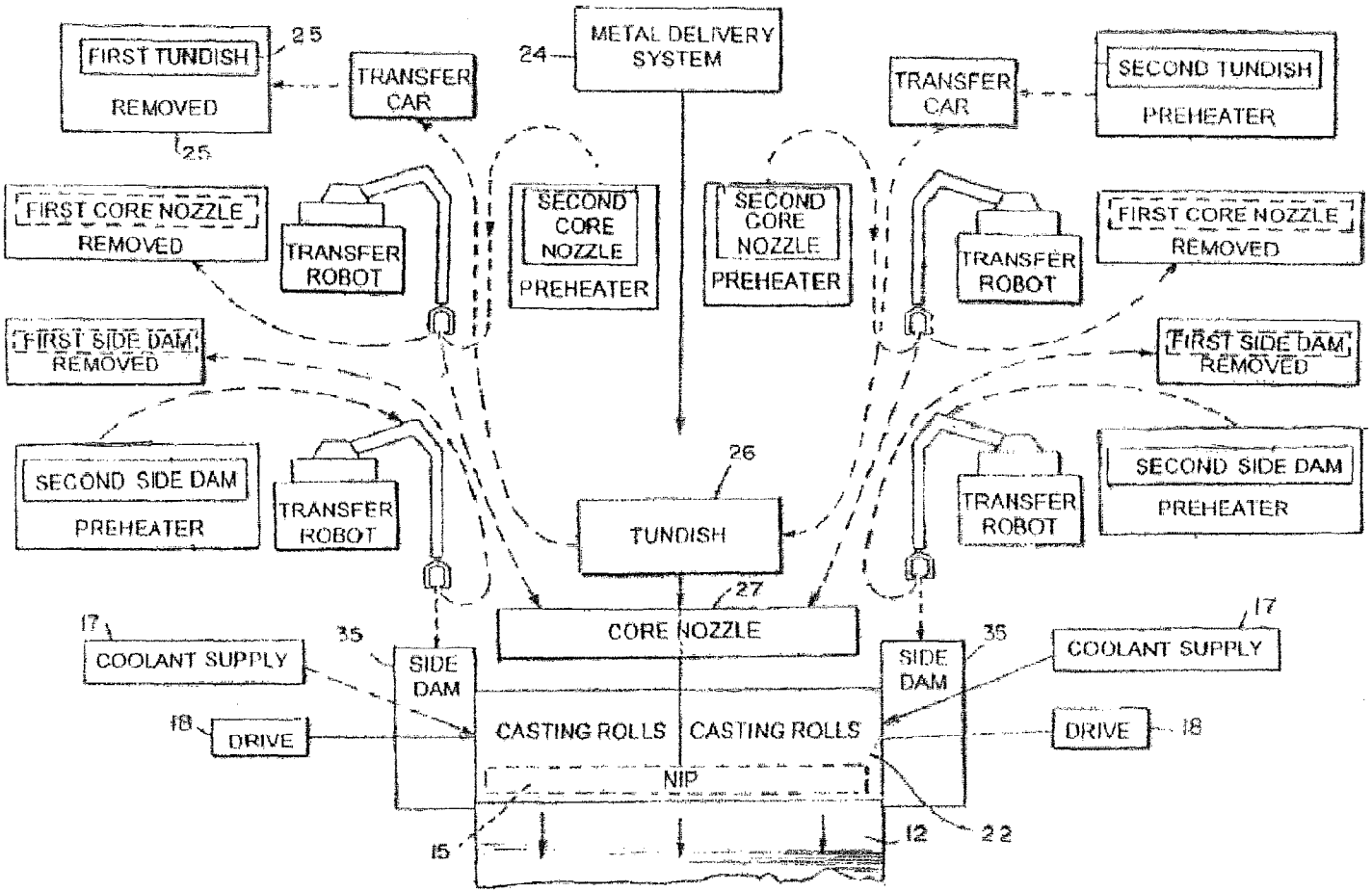
FIGS. 1A-1G illustrate various aspects of an exemplary continuous twin roll caster system in which embodiments of the present invention are employed;.

FIGS. 1A-1G illustrate a continuous twin roll caster system in which embodiments of the present invention are employed. The twin roll caster generally denoted as 11 produces a cast steel strip 12, which passes through a sealed enclosure 10 to a guide table 13 and thereafter to a pinch roll stand 14, through which it exits the sealed enclosure 10. The seal of the enclosure 10 may not be complete, but appropriate to allow control of the atmosphere within the enclosure and limit of oxygen to the cast strip within the enclosure as hereinafter described. After exiting the sealed enclosure 10, the strip may pass through other sealed enclosures and may be subjected to in-line hot rolling and cooling treatment which is not part of the present invention.

Twin roll caster 11 comprises a pair of laterally positioned casting rolls 22 forming a nip 15 therebetween, to which molten metal from a ladle 23 is delivered through a metal delivery system 24. Metal delivery system 24 comprises a tundish 25, a removable tundish 26 and one or more core nozzles 27 which are located above the nip 15. The molten metal delivered to the casting rolls to form a casting pool 16 on the casting surfaces of the casting rolls 22 above the nip 15. The casting pool of molten steel supported on the casting rolls is confined at the ends of the casting rolls 22 by a pair of first side dams 35, which are applied to stepped ends of the rolls by operation of a pair of hydraulic cylinder units 36 acting through thrust rods 50 connected to side dam holders 37.

The casting rolls 22 are internally cooled by coolant supply 17, typically water. The casting rolls 22 are driven in counter rotational direction by drives 18, so that metal shells solidify on the moving casting roll surfaces as the casting surfaces move through the casting pool 16. These metal shells are brought together at the nip 15 to produce the thin cast strip 12, which is delivered downwardly from the nip 15 between the rolls.

Figure 1B:
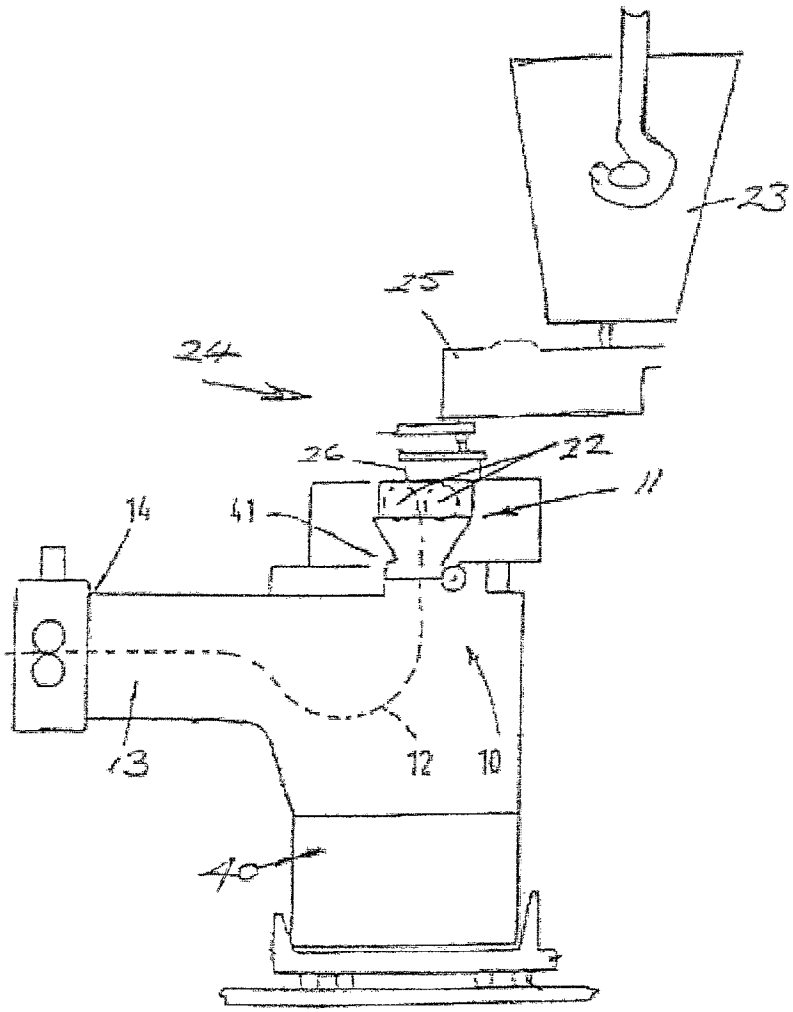
Figure 1C:
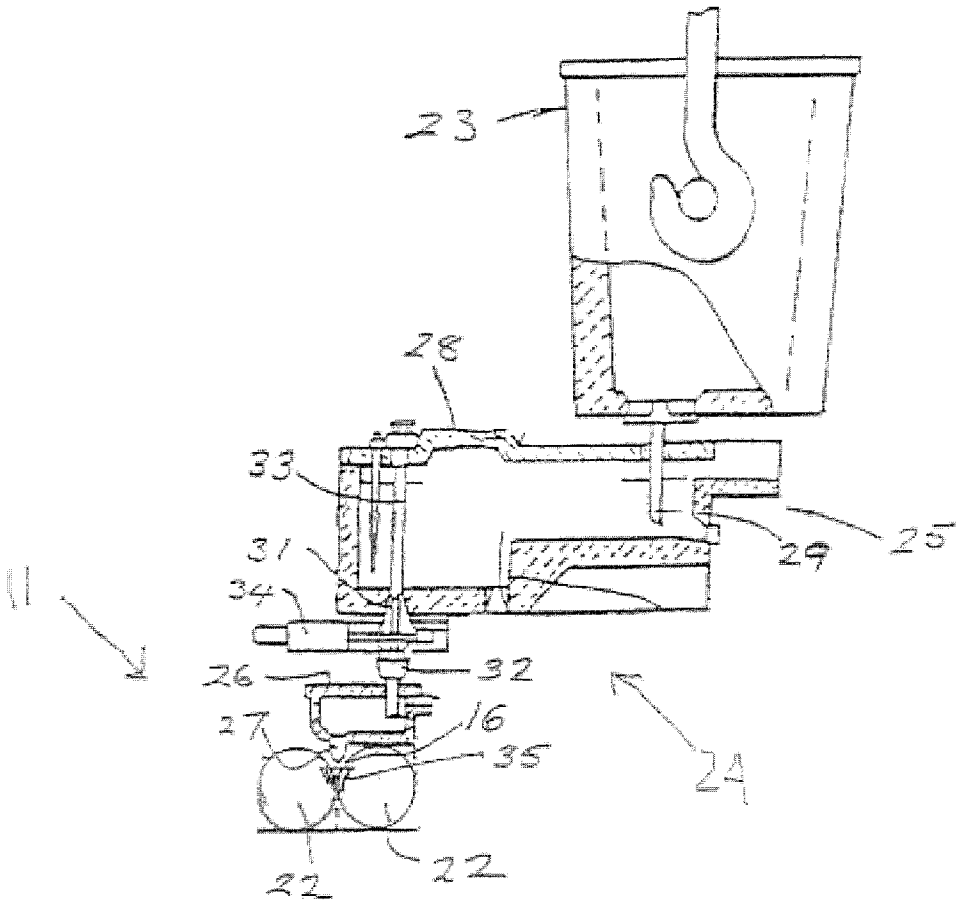
Figure 1D:
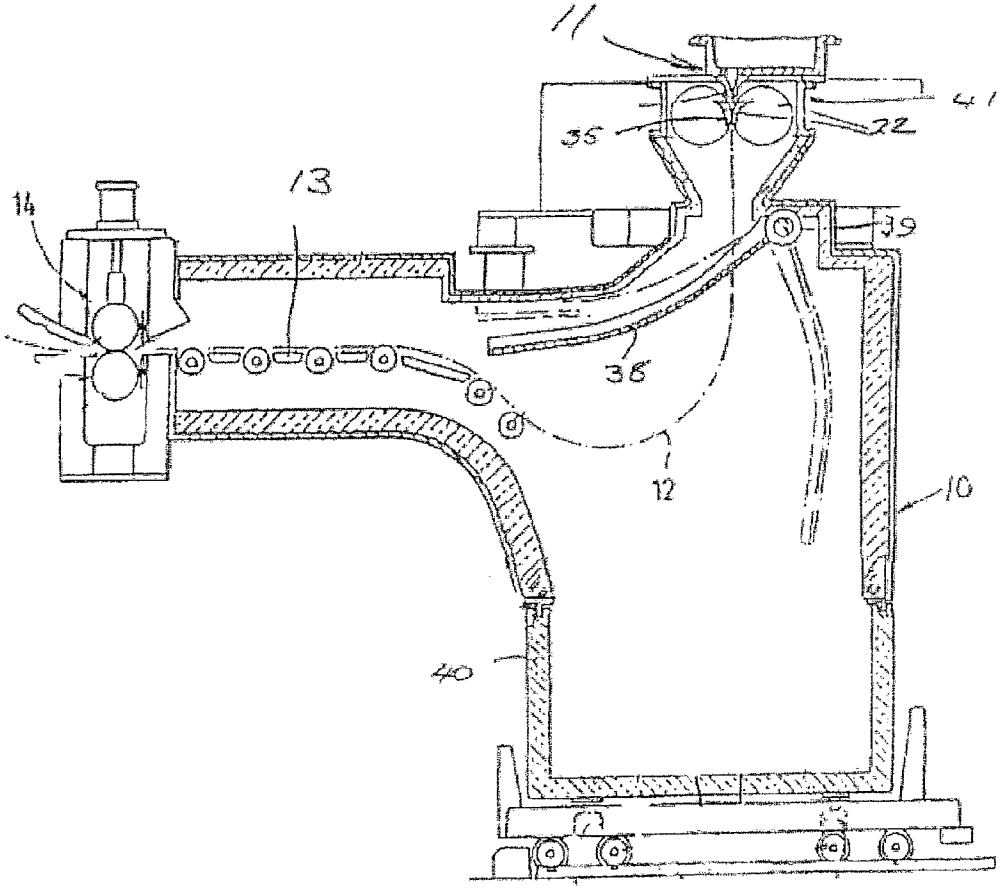
Figure 1E:
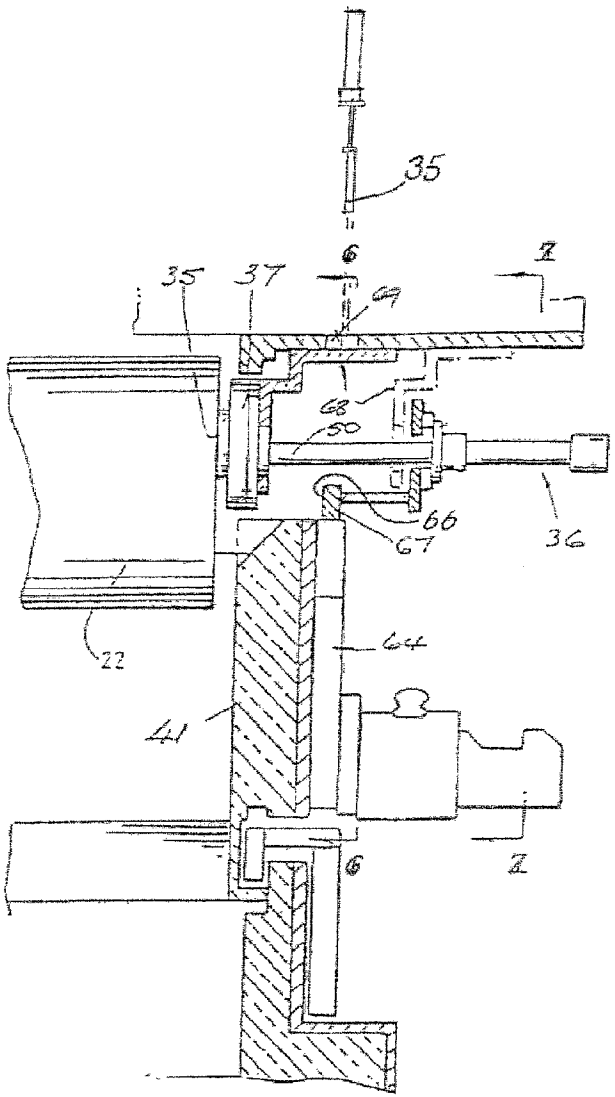
Figure 1F:
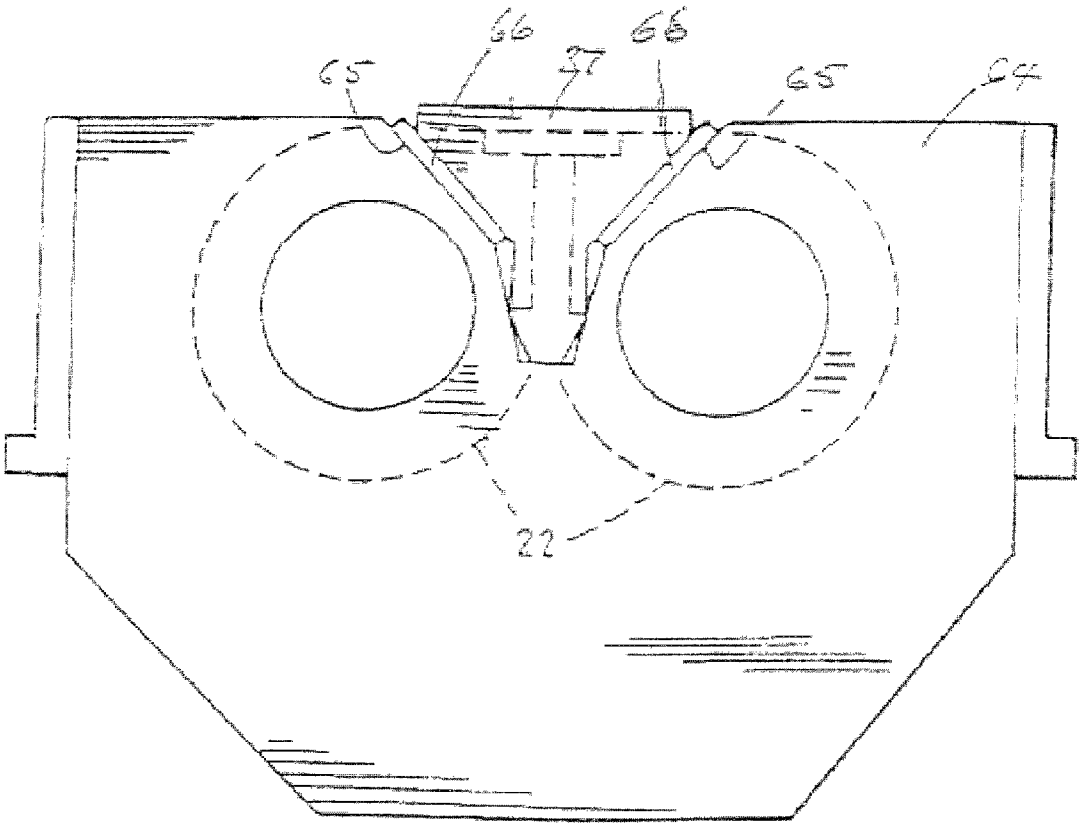
Figure 1G:
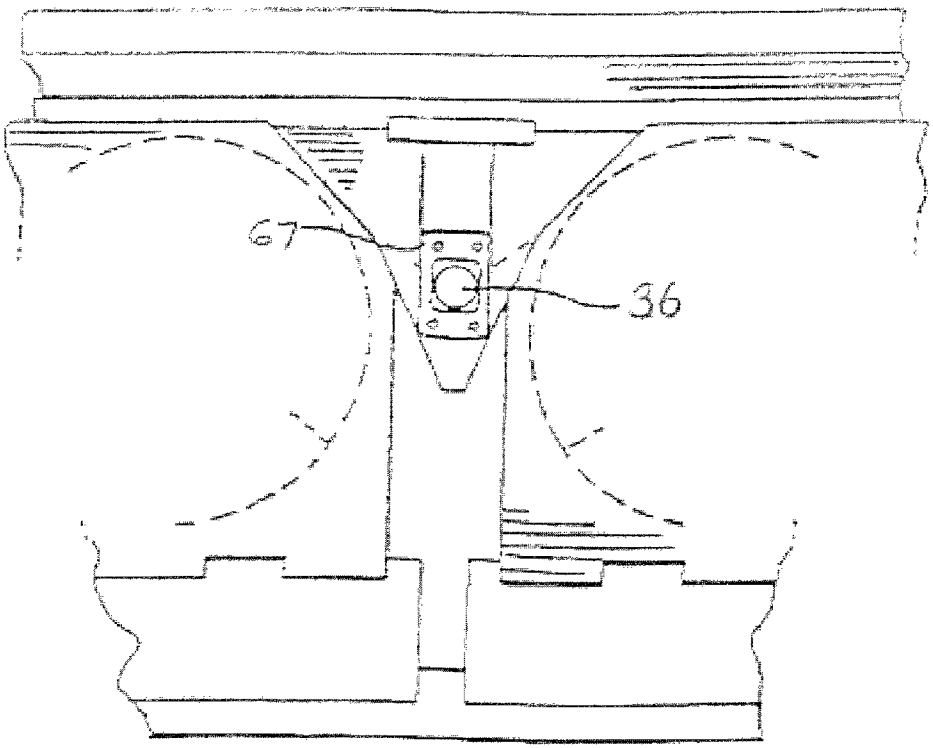

Tundish 25 is fitted with a lid 28. Molten steel is introduced into the tundish 25 from ladle 23 via an outlet nozzle 29. The tundish 25 is fitted with a stopper rod 33 and a slide gate valve 34 to selectively open and close the outlet 31 and effectively control the flow of metal from the tundish to the removable tundish 26. The molten metal flows from tundish 25 through an outlet 31 through an outlet nozzle 32 to removable tundish 26, (also called the distributor vessel or transition piece), and then to core nozzles 27. At the start of a casting operation a short length of imperfect strip is produced as the casting conditions stabilize. After continuous casting is established, the casting rolls are moved apart slightly and then brought together again to cause the leading end of the strip to break away, so as to form a clean head end of the following cast strip to start the casting campaign. The imperfect material drops into a scrap box receptacle 40 located beneath caster 11 and forming part of the enclosure 10 as described below. At this time, swinging apron 38, which normally hangs downwardly from a pivot 39 to one side in enclosure 10, is swung across the strip outlet from the nip 15 to guide the head end of the cast strip onto guide table 13, which feeds the strip to the pinch roll stand 14. Apron 38 is then retracted back to its hanging position to allow the strip to hang in a loop beneath the caster, as shown in FIGS. 1B and 1D, before the strip passes to the guide table where it engages a succession of guide rollers.

The twin roll caster illustratively may be of the kind which is illustrated in some detail in U.S. Pat. Nos. 5,184,668 and 5,277,243, and reference may be made to those patents for appropriate constructional details which form no part of the present invention.

Enclosure 10 has a wall section 41 surrounds the casting rolls 22. Enclosure 10 is formed with side plates 64 provided with notches 65 shaped to snugly receive the side dam plate holders 37, when the pair of side dams 35 are pressed against the ends of casting rolls 22 by the cylinder units 36. The interfaces between the side dam holders 37 and the enclosure side wall sections 41 are sealed by sliding seals 66 to maintain sealing of the enclosure 10. Seals 66 may be formed of ceramic fiber rope or other suitable sealing material.

The cylinder units 36 extend outwardly through the enclosure wall section 41 and are effectively sealed by sealing plates 67 fitted to the cylinder units, so as to engage with the enclosure wall section 41 when the cylinder units are actuated to press the pool closure plates against the ends of the casting rolls. Cylinder units 36 also move refractory slides 68 which, upon actuation, close slots 69 in the top of the enclosure, through which the side dams 35 are inserted into the enclosure 10 and into the holders 37 for application to the casting rolls when the casting campaign is commenced. The top of the sealed enclosure 10 is closed by the tundish 26, the side dam holders 37 and the slides 68 when the cylinder units are actuated to urge the side dams 35 against the casting rolls 22.

Figure 2:
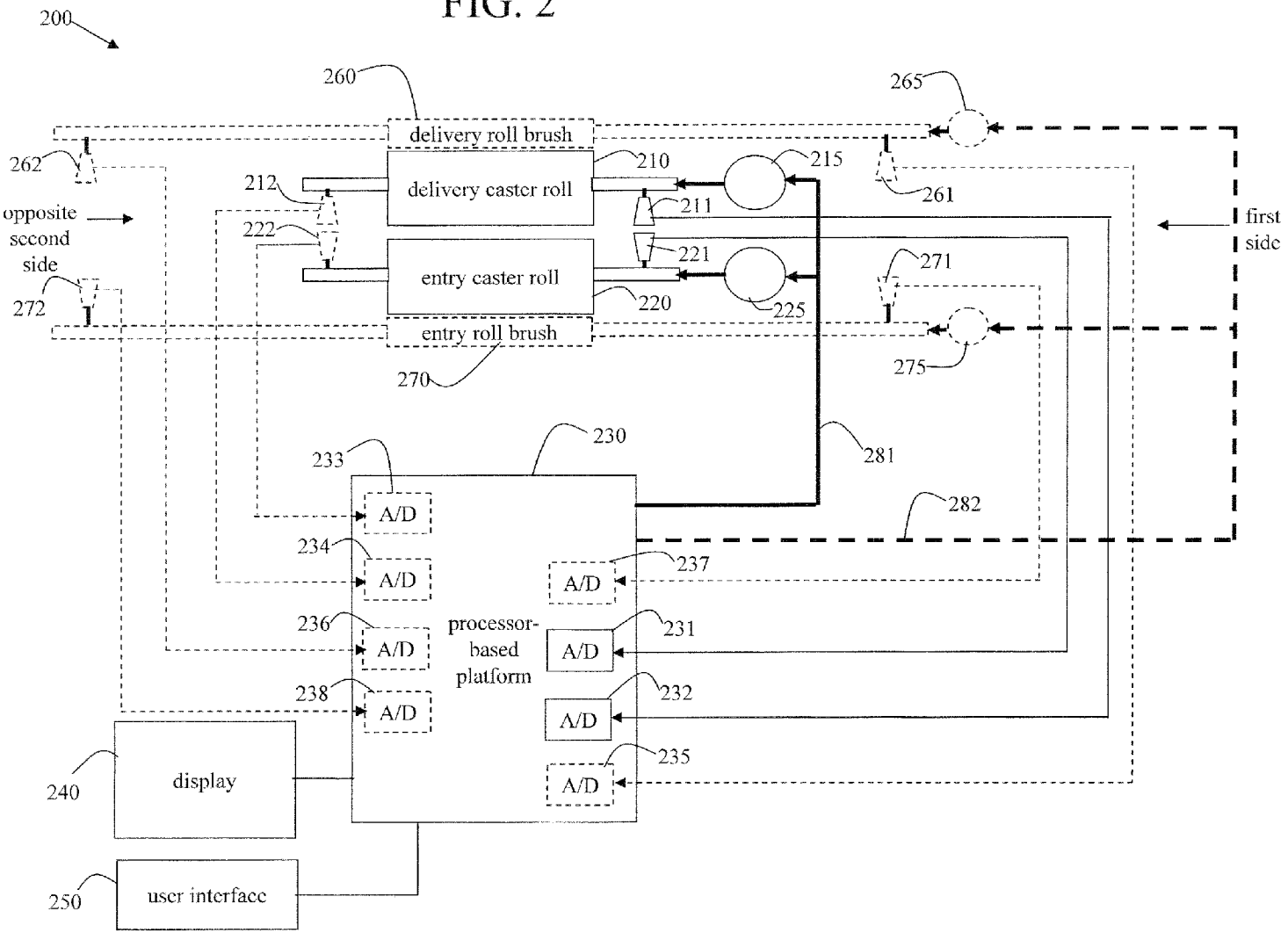
FIG. 2 is a schematic block diagram illustrating a subsystem used in a twin roll caster system, similar to the twin roll caster system of FIGS. 1A-1G, and used to reduce causes of variability and defects in thin cast metal strip during a casting process.

FIG. 2 is a schematic block diagram illustrating a subsystem 200 used in a twin roll caster system, similar to the twin roll caster system II of FIGS. 1A-1G. Subsystem 200 is used to reduce the causes of variability and defects in thin cast metal strip during a casting process.

The subsystem 200 includes a first force sensor 211 operationally connected, typically to the chocks, at a first end of first casting roll 210 of the pair of casting rolls 22. The subsystem 200 continuously measures a first force on the first end of first casting roll 210 during a casting campaign. The subsystem 200 also includes a second force sensor 221 operationally connected to a first end, typically at the chocks, of second casting roll 220 of casting rolls 22 on a first side of the subsystem 200, to continuously measure a second force on the first end of casting roll 220 during the casting campaign.

The subsystem 200 optionally may further include a third force sensor 212 operationally connected, typically at the chocks, to an opposite second end of first casting roll 210 on a second opposite side, to continuously measure a third force on said opposite second end of casting roll 210 during casting. The subsystem 200 also may optionally include a fourth force sensor 222 operationally connected, typically at the chocks, to an opposite second end of second casting roll 220, to continuously measure a fourth force on the opposite second end of second casting roll 220 during casting.

In general, the forces are measured in a direction transverse to the axes of the casting rolls 210 and 220 typically at ends of first and second casting rolls 210 and 220. It is these transverse forces at the ends of the casting rolls which can be correlated to defects in the formed cast metal strip. In accordance some embodiments of the present invention, only the pair of force sensors 211 and 221 may be employed, or alternatively only the pair of force sensors 212 and 222 may be employed. In other embodiment, all four force sensors 211, 212, 221, and 222 are employed to provide more complete data to more accurately identify and correct for defects in the cast strip.

The sensors 211, 212, 221, 222 may comprise load cells or strain gauges, for example. Other types of sensors may be used as desired such as, for example, accelerometers attached to the chocks of the casting rolls, or transducers that measure the delta pressure on the hydraulic cylinders. In general, any type of sensor that is capable of measuring a force-related parameter (e.g., force, strain, acceleration, pressure) may be used. The time domain signals output by the sensors 211, 212, 221, 222 may comprise analog electrical signals or digital electrical signals. When the time domain force signals are analog electrical signals, analog-to-digital (A/D) converters 231 and 232 (and optionally 233 and 234) are employed in the subsystem 200 to convert the analog signals to sampled digital time domain signals. The A/D converters 231-234 may be a part of the processor-based platform 230. Alternatively, the A/D converters 231-234 may be external to the processor-based platform 230 described below.

In any case, subsystem 200 also includes a processor-based platform 230 operationally connected to two force sensors 211 and 212, or two force sensors 221 and 222, or all four of these force sensors, to receive one time domain signal from each of the force sensors and to transform the two or four time domain force signals into two or four corresponding frequency domain spectrums. Each frequency domain spectrum corresponds to the time domain signal generated by one of the force sensors.

Information derived from the transformed frequency domain spectrums may be displayed to an operator (i.e., a user) on a display 240, which is operationally connected to the processor-based platform 230. The operator can take action, in response to the displayed frequency domain spectrums, through a user interface 250 to adjust the speed of rotation of either or both of casting rolls 210 and 220, to adjust the casting pool height, and/or to adjust the gap separation force applied between the casting rolls 210 and 220.

In accordance with another embodiment, the processor-based platform 230 is programmed, either through software or firmware, to automatically analyze the frequency domain spectrums and generating control signals 281 in response to that analysis. The control signals 281 may be used to adjust a rotational speed of first casting roll 210 and/or second casting roll 220, in accordance with a desired embodiment. Rotational drives 215 and 225 are operationally connected to first casting roll 210 and second casting roll 220, respectively. The control signals 281 may be adapted, or modified, to adjust the speed of rotation as described via the rotational drives 215 and 225. For this purpose, the rotational drives 215 and 225 may include control circuitry and control mechanisms in addition to the actual drive mechanics. Alternatively or in addition, control signals 281 may be used to adjust the casting pool height or the roll separation force, or both.

The display 240 may comprise any of a number of various types of displays capable of displaying textual and graphical information. The user interface 250 may also comprise a keyboard, a touch screen panel, or any other type of appropriate user interface. The user interface 250 may be an integral part of the display 240.

The processor-based platform may comprise a personal computer (PC), a work station, or some other type of processor-based platform having at least one processor (e.g., a CPU) capable of executing software instructions, in accordance with various embodiments of the present invention. For example, the processor-based platform is part of a LabVIEW-based system which is used as a high-speed data logger. LabVIEW is a graphical programming language from National Instruments. Included in the LabVIEW distribution is an extensive development environment with many libraries and tools. The graphical language is named "G". Originally released for the Apple Macintosh in 1986, LabVIEW is used for data acquisition, instrument control, and industrial automation on a variety of processor-based platforms including Microsoft Windows, UNIX, Linux, and Mac OS.

Figure 3:
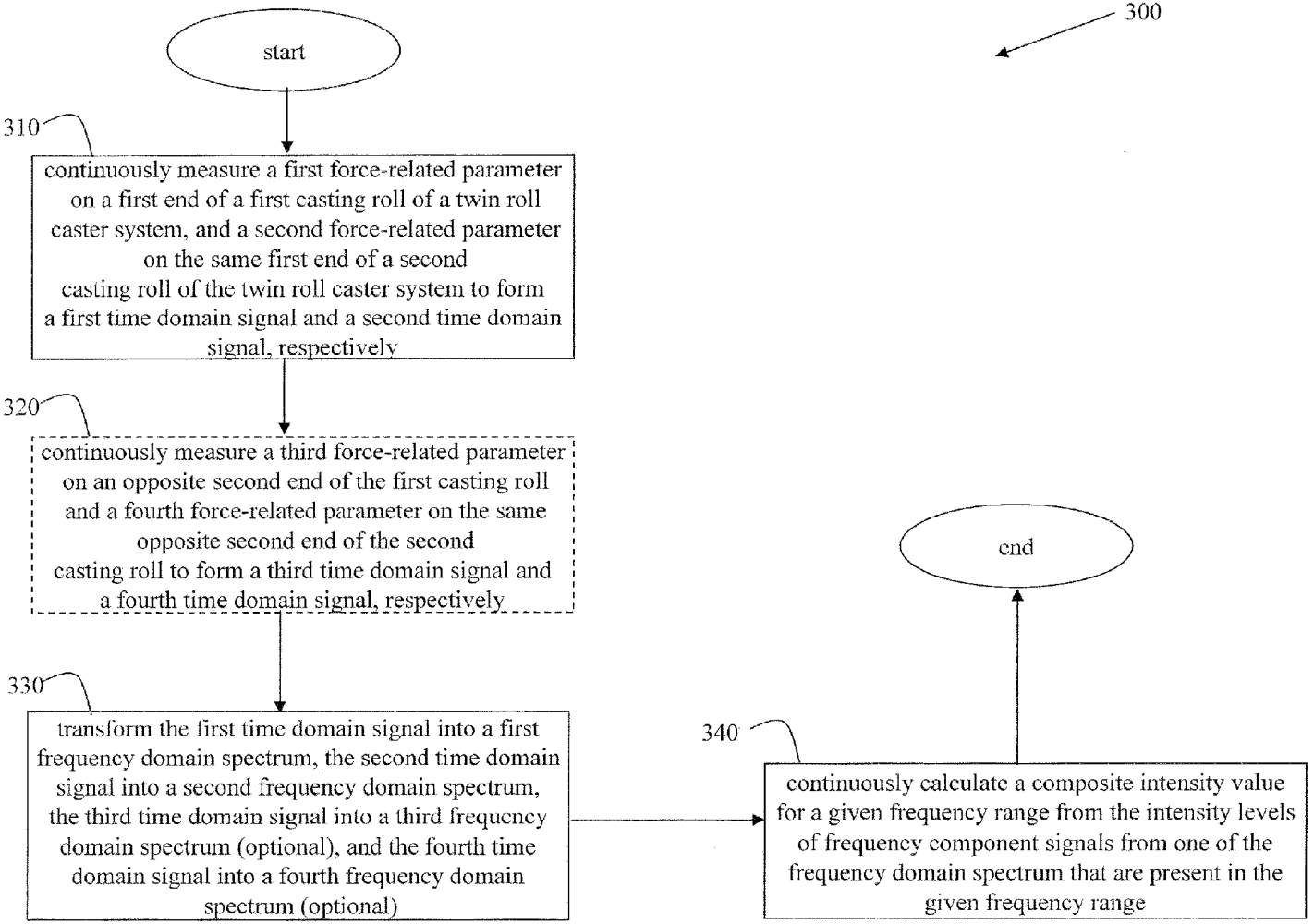
FIG. 3 is a flowchart illustrating a first embodiment of method used in a twin roll caster system to reduce causes of variability and defects in thin cast strip during a casting process using at least portions of the subsystem of FIG. 2.

FIG. 3 is a flowchart illustrating a method 300 used in a twin roll caster system to reduce the causes of variability and defects in thin cast strip during a casting campaign, using the subsystem 200 of FIG. 2 in accordance with a desired embodiment. The steps of the method 300 are accomplished as described below herein.

In step 310, a first force-related parameter is continuously measured on a first end of a first casting roll of a twin roll caster system and a second force-related parameter is continuously measured on the same first end of a second casting roll of the twin roll caster system, to generate a first time domain signal and a second time domain signal, respectively. In step 320, a third force-related parameter is continuously measured on an opposite second end of the first casting roll and a fourth force-related parameter is continuously measured on the same opposite second end of the second casting roll, to generate a third time domain signal and a fourth time domain signal, respectively. Step 320 is optional. In step 330, the first time domain signal is transformed into a first frequency domain spectrum and the second time domain signal is transformed into a second frequency domain spectrum, and if desired, the third time domain signal is transformed into a third frequency domain spectrum, and the fourth time domain signal is transformed into a fourth frequency domain spectrum.

In step 340, a composite intensity value is continually calculated for a given frequency range from the intensity levels of the frequency component signals from each frequency domain spectrum that are present in the given frequency range. That is, at least a portion of the frequency component signals of one of the frequency domain spectrum are used to calculate the composite intensity value. The continual calculation of composite intensity values may be for several given frequency ranges from the frequency domain spectrums, e.g., less than 14 Hz, 14 to 52 Hz, and above 52 Hz as described below. In accordance with an embodiment of the present invention, the composite intensity value is a peak-to-peak value calculated from the intensity levels of the identified frequency component signals that are present within the predefined frequency range.

The composite intensity values are subsequently used to either manually or automatically adjust certain parameters of the twin roll caster system to reduce, if not eliminate, the causes of the defects in the thin cast strip, as described in more detail below.

As described above, the time domain force signals are generated by two or four of force sensors 211, 212, 221, 222. The processor-based platform 230 receives the time domain force signals and transforms the time domain force signals to frequency domain spectrums. The processor-based platform 230 applies a Fourier transform process (e.g., a Fast Fourier Transform or FFT) to the time domain force signals to generate the frequency domain spectrums. The Fourier Transform algorithm contemplated is "Real FFT" which is a part of Labview. In accordance with alternative embodiments, other transform techniques are possible as well such as, for example, wavelet transformation techniques (processes). Again, only two force sensors (e.g., 211 and 221) may be employed, resulting in two time domain signals and two frequency domain spectrums. Using all four force sensors 211, 221, 212, and 222 is an option that provides more data to the operator or the automated system to identify and reduce defects in the cast strip.

Figure 4A:
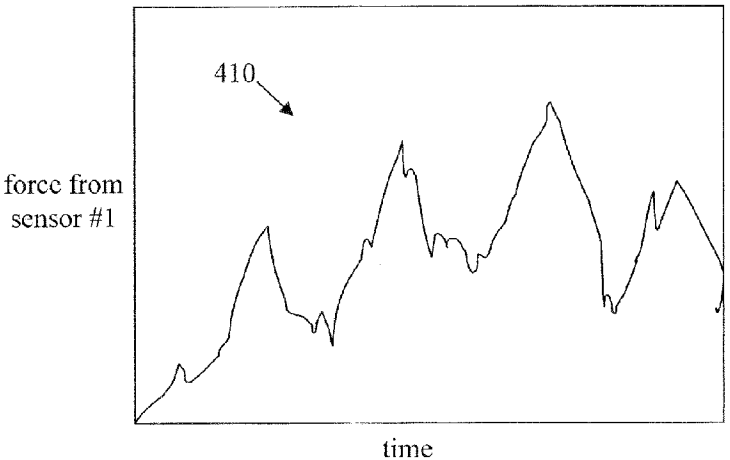
FIGS. 4A-4D illustrate exemplary of graphs of time domain force signals measured by the subsystem of FIG. 2 using the method of FIG. 3.
Figure 4B:
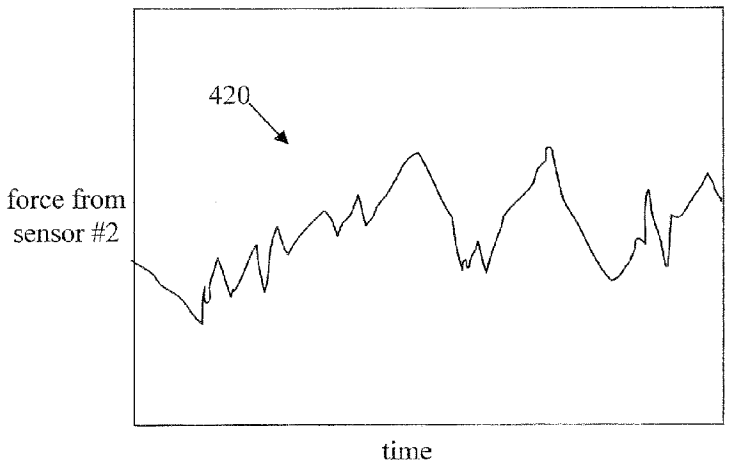
Figure 4C:
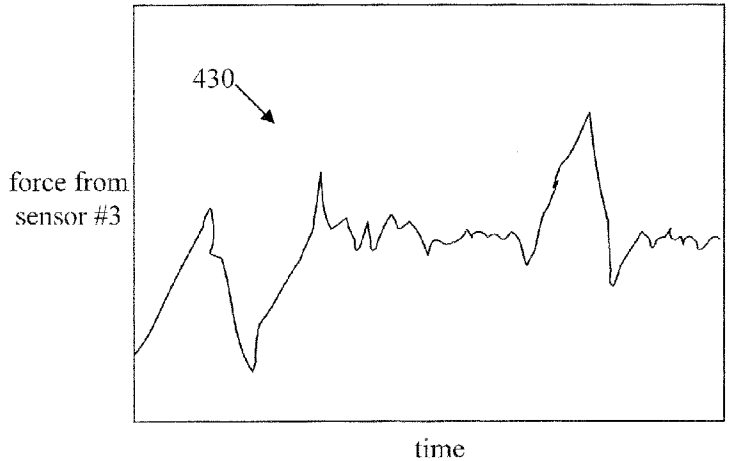
Figure 4D:
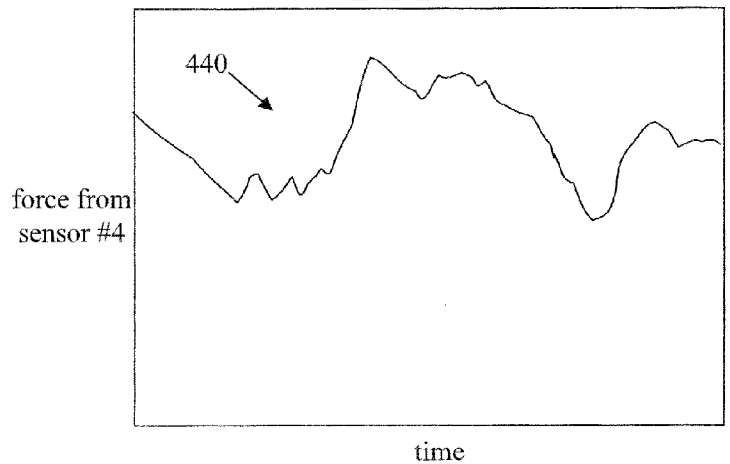
Figure 5C:
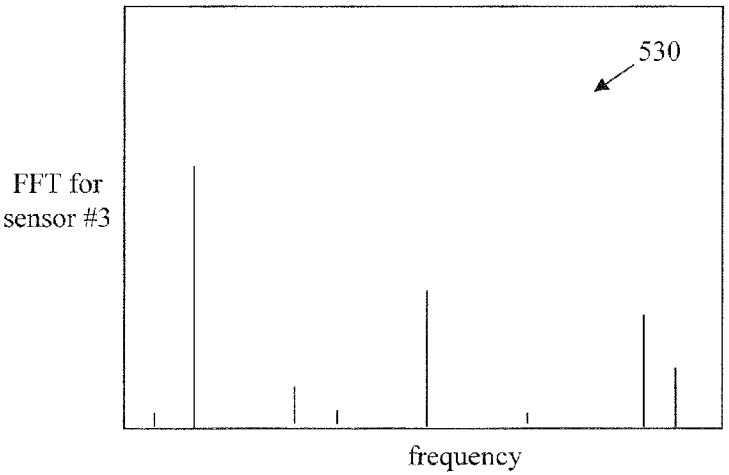
FIGS. 5A-5D illustrate exemplary graphs or plots of frequency domain spectrums derived from the time domain force signals of FIGS. 4A-4D.
Figure 5D:
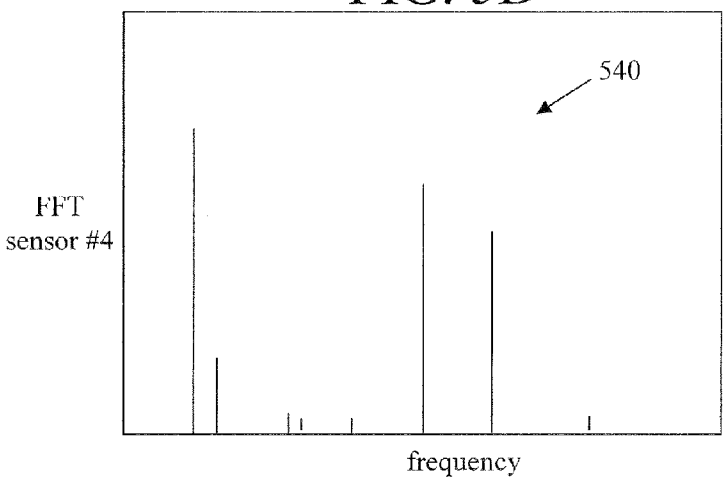
Figure 5A:
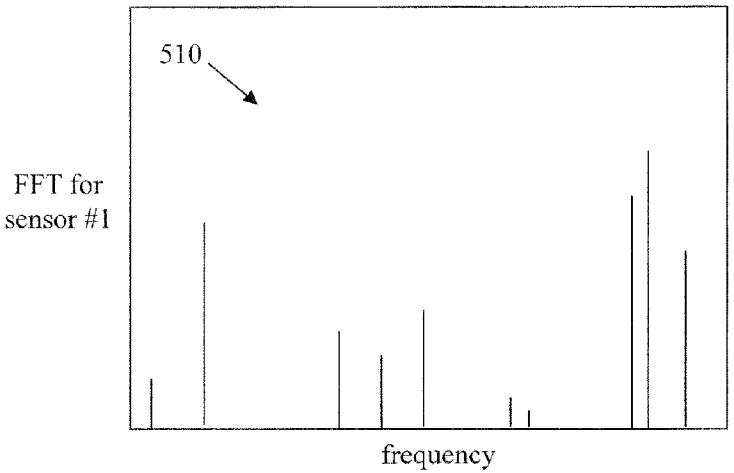
Figure 5B:
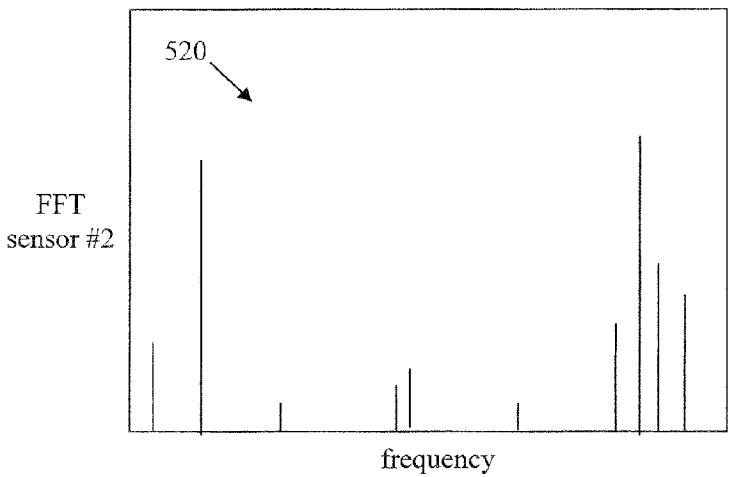

FIGS. 4A-4D illustrate exemplary graphs of time domain force signals measured by the subsystem 200 of FIG. 2 using the method 300 of FIG. 3. FIG. 4A is an exemplary graph representing the force from sensor 211. FIG. 4B is an exemplary graph representing the force from sensor 212. FIG. 4C is an exemplary graph representing the force from sensor 221. FIG. 4D is an exemplary graph representing the force from sensor 222. The corresponding time domain force signals 410, 420, 430, and 440 are composed of low, medium, and high frequency signals of various force or amplitude levels (i.e., intensity levels).

FIGS. 5A-5D illustrate exemplary graphs or plots of frequency domain spectrums derived from the time domain force signals of FIGS. 4A-4D. The frequency domain spectrums 510, 520, 530, and 540 are a result of the transformation processes performed by the processor-based platform 230 of FIG. 2 operating on the corresponding time domain force signals 410, 420, 430, and 440. All frequency components are formed in the spectrums, not just harmonic components of rotation of the casting rolls.

As can be seen in the graphs of FIG. 5A-5D, various lower and higher frequency components appear which may be correlated with various types of defects that will occur in the cast steel strip being formed from the nip between the casting rolls. The frequency domain graphs of FIGS. 5A-5D, or other information derived from the frequency domain spectrums, may be displayed to an operator on the display 240. In this way, an operator may view the spectrums to 510-540, or alternatively only derived composite values, to perform real time diagnostics to identify and make adjustments to defects that would be otherwise present in the cast strip.

Alternatively, the frequency domain spectrums may be automatically analyzed by the processor-based platform 230 to facilitate real time control of at least one of the rotational speed of casting rolls 210 and/or 220, the casting pool height, and/or the gap separation force applied between the casting rolls 210 and 220. As part of the analysis process, individual spectral components within the frequency domain spectrums may be identified. For example, the control signals 281 may be continuously generated and modified in response to the composite intensity values, and are transmitted to the rotational drives 215 and/or 225 to adjust and control of rotational speed as desired.

As described previously herein, the frequency domain spectrums are converted to composite intensity levels within one or more given frequency ranges within the frequency domain spectrums and not just harmonic frequencies associated with the period of rotation of the casting rolls. A composite intensity value is continually calculated from the frequency component signals from the frequency domain spectrum that are present within at least a given frequency range. In other words, as the time domain force signals are received and transformed to frequency domain spectrum, the intensity levels of those spectral components within at least one given frequency range are converted to a single composite intensity value for a given point in time. Such a process is continued over time to generate a plurality of composite intensity values which may be plotted as intensity level versus time, and may be displayed on a display to be viewed by an operator.

The method of calculating the composite intensity value may be any of a variety of different methods such as, for example, averaging-like methods. The composite intensity value may be determined by calculating the root-mean-square (RMS) of the intensity levels of the identified frequency component signals that are present within the preselected frequency range. The corresponding RMS mathematical formula is:

$$I_{rms}=[1/N(\Sigma X_i^2)]^{1/2}, \text{ where}$$

$I_{rms}$ is the root-mean-square intensity value, $X_i$ is an intensity level of the $i^{th}$ frequency component within the predefined frequency range, N is the number of frequency components present in the predefined frequency range where the summation, Σ, is being done over the index i from i=1 to N.

Alternatively, the composite intensity value may be determined by calculating the root-sum-square (RSS) of the intensity levels of the identified frequency component signals that are present within the preselected frequency range. The corresponding RSS mathematical formula is:

$$I_{rss}=[(\Sigma X_i^2)]^{1/2}, \text{ where}$$

$I_{rss}$ is the root-sum-square intensity value, $X_i$ is an intensity level of the $i^{th}$ frequency component within the predefined frequency range, the summation, Σ, is being done over the index i from i=1 to N, where N is the number of frequency components present in the predefined frequency range.

Figure 6A:
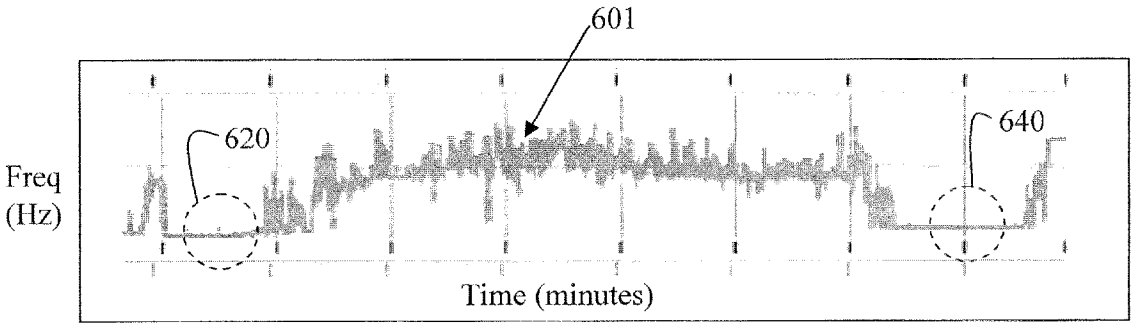
FIGS. 6A-6B illustrates exemplary of graphs or plots of frequency versus time, and root-mean-square intensity versus time derived from the frequency component signals within the frequency domain spectrums of FIGS. 5A-5D.
Figure 6B:
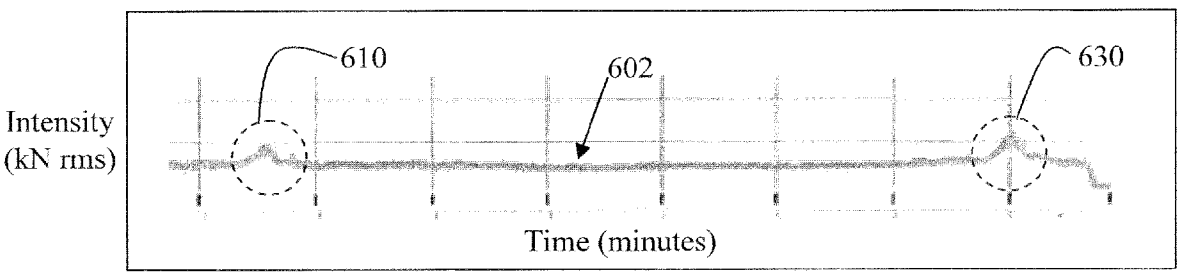

FIGS. 6A-6B illustrates exemplary graphs or plots of frequency versus time, and root-mean-square intensity versus time derived from the frequency component signals within the frequency domain spectrums of FIGS. 5A-5D. Referring to FIG. 6A, the spectral frequency components 601 that are present within a given frequency range (e.g., 60 to 100 Hz) are plotted over time. The spectral frequency components 601 are derived from the frequency domain spectrums that are continually being generated from the measured force signals over time, as previously described herein.

Referring to FIG. 6B, the composite intensity values 602 (in this case, the RMS intensity values) are plotted over time. The composite intensity values 602 are derived from the spectral frequency components 601 shown in FIG. 6A. Therefore, by looking at the two plots together, the frequency components that are contributing to a particular RMS intensity value at a particular time may be observed. For example, the change in RMS intensity in the region 610 of FIG. 6B is due to the frequency components present in the region 620 of FIG. 6A. Similarly, the change in RMS intensity in the region 630 of FIG. 6B is due to the frequency components present in the region 640 of FIG. 6A.

An increase in the RMS intensity level 602 during the casting process can cause defects in the resultant thin cast metal strip. When the plotted RMS intensity level 602 increases above a certain predefined threshold level, an operator of the twin roll casting system may adjust or modify a parameter of the system (e.g., a speed of rotation of one or both of the casting rolls 210 and 220) to bring the RMS intensity level back down, thus eliminating or at least reducing any defects caused by the increase in the RMS intensity level within the monitored predefined frequency range. Alternatively or in addition, the casting pool height and or gap separation force applied between the casting rolls 210 and 220 may be adjusted by the operator.

In an embodiment, a predefined frequency range may comprise one of about 0 to 14 Hz, about 14 to 52 Hz, and about above 52 Hz. Other frequency ranges may be selected as desired in accordance with desired embodiments. Defects caused by vibrations in the frequency range of 0 to 14 Hz typically include twice-per-roll revolution-related type defects (e.g., due to 2× caster roll rotation frequencies), white line type defects (e.g., due to occasional loss of contact of the casting roll with the metal), and herring-bone type defects (e.g., due to applied forces to the casting rolls being too high). Defects caused by vibrations in the frequency range of 14 to 52 Hz typically include brush-induced vibration defects (e.g., due to 1× and 2× brush rotation frequencies), and high frequency roll vibration defects (e.g., due to applied forces to the brushes being too high). Defects caused by vibrations in the frequency range above 52 Hz typically include 1× casting roll defects due to uncompensated roll eccentricity and/or casting pool turbulence (i.e., inadequate metal delivery).

A predetermined program of priorities may be followed when manually or automatically adjusting the controlled parameters (e.g., casting speed and gap force). For example, the rotational speed of the casting rolls may be adjusted first within given parameters to induce a reduction in the defect-related effects. Next, the gap separation force applied to the casting rolls may be adjusted within given parameters to further reduce the defect-related effects, if desired. Finally, the height of the casting pool may be adjusted within given parameters to even further reduce the defect-related effects, if desired. Further or other predetermined schedules of priorities of adjustment may be programmed as desired to identify and correct for defects in the cast strip.

Figure 7:
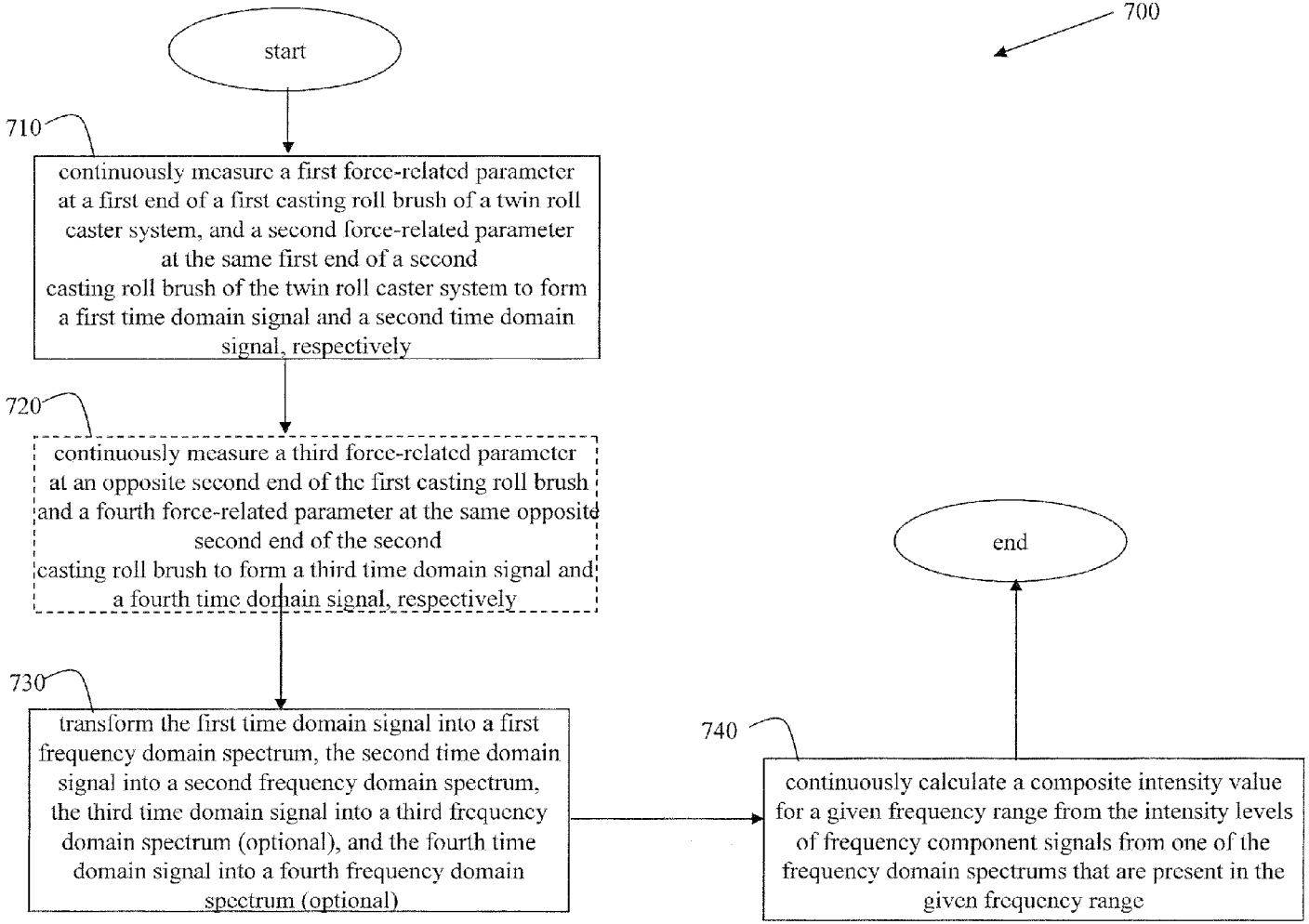
FIG. 7 is a flowchart of a second embodiment of a method used in a twin roll caster system to reduce causes of variability and defects in thin cast strip during a casting process using at least portions of the subsystem of FIG. 2.

FIG. 7 is a flowchart of a second exemplary embodiment of a method 700 used in a twin roll caster system to reduce the causes of variability and defects in thin cast strip during a casting process using at least portions of the subsystem 200 of FIG. 2, as previously described. The steps of the method 700 are accomplished as described below herein.

In step 710, a first force-related parameter is continuously measured on a first end of a first casting roll brush servicing first casting roll 210 typically at the chocks, and a second force-related parameter is continuously measured on the same first end of a second casting roll brush servicing second casting roll 220 again typically at the chocks, to generate a first time domain signal and a second time domain signal, respectively. In step 720, a third force-related parameter may be continuously measured on an opposite second end of the first casting roll brush typically at the chocks, and a fourth force-related parameter is continuously measured on the same opposite second end of the second casting roll brush typically at the chocks, to generate a third time domain signal and a fourth time domain signal, respectively. Step 720 is an optional step. In step 730, the first time domain signal is transformed into a first frequency domain spectrum and the second time domain signal is transformed into a second frequency domain spectrum, and if available, the third time domain signal may be transformed into a third frequency domain spectrum, and the fourth time domain signal may be transformed into a fourth frequency domain spectrum.

In step 740, a composite intensity value is continually calculated for a given frequency range from the intensity levels of frequency component signals from at least one of the frequency domain spectrums that are present within the given frequency range.

Referring again to FIG. 2, the subsystem 200 optionally includes a first casting roll brush 260 being adjacent to and capable of being in contact with the casting surfaces of first casting roll 210. Similarly, the subsystem 200 optionally includes a second casting roll brush 270 being adjacent to and capable of being in contact with the casting surfaces of second casting roll 220. The brushes 260 and 270 may be rotated via rotational drives 265 and 275 and serve to clean the casting roll surfaces of casting rolls 210 and 220 during a casting process. Rotational drives 265 and 275 are operationally connected to first casting roll brush 260 and second casting roll brush 270, respectively. The control signals 282 may adjust the speed of rotation via the rotational drives 265 and 275. The rotational drives 265 and 275 may include control circuitry and control mechanisms in addition to the actual drive mechanics.

Only the pairs of force sensor 261 and 271 may be employed, or alternatively, only the pair of force sensors 262 and 272 may be employed. However, all four force sensors may be used on the brushes 260 and 270 are measured in a direction that is transverse to the axes of the brushes 260 and 270. The sensors 261, 262, 271, 272 may comprise load cells or strain gauges; however, other types of sensors may be used as desired such as, for example, accelerometers attached to the chocks of the casting rolls, or transducers measuring the delta pressure on the hydraulic cylinders. In general, any type of sensor that is capable of measuring a force-related parameter (e.g., force, strain, acceleration, pressure) may be used. The forces are measured by the optional force sensors 261, 262, 271, and 272, in a manner similar to that for the casting rolls 210 and 220 using the force sensors 211, 212, 221, and 222 as described above.

It is these two or four transverse forces at the ends of the casting roll brushes which can be correlated to defects being formed in the cast metal strip.

The processor-based platform 230 is operationally connected to at least two of the force sensors as described above to receive one time domain signal from each of the force sensors, and to transform the two or four time domain force signals into two or four corresponding frequency domain spectrums. Each frequency domain spectrum corresponds to one of the force sensors. The force sensors 261, 262, 271, and 272 are operationally connected to corresponding optional A/D converters 235, 236, 237, and 238, respectively, within the processor based platform 230 to achieve sampling and digital conversion of the analog time domain signals from the force sensors. The force sensors 261, 262, 271, and 272 may output such time domain signals in digital form, eliminating the need for the A/D converters in the processor-based platform 230.

Information from the composite values derived from the frequency domain spectrums may be displayed for an operator on a display 240, which is operationally connected to the processor-based platform 230. The operator, in response to the displayed data, can take action through a user interface 250 to adjust the speed of rotation of either or both of the casting roll brushes 260 and 270, or to adjust the forces applied by the casting roll brushes 260 and 270 against the casting surfaces of casting rolls.

The processor-based platform 230 is capable of analyzing the frequency domain spectrums, and generating control signals 282 in response to the analysis. The control signals 282 are used to adjust a rotational speed of first casting roll brush 260 and/or second casting roll brush 270. Rotational drives 265 and 275 may be connected to first casting roll brush 260 and second casting roll brush 270, respectively. The control signals 282 may operate to adjust the speed of rotation as described via the rotational drives 265 and 275. Alternatively or in addition, the control signals 282 may operate to adjust the forces applied by one or both of casting roll brushes 260 and 270 against the casting surfaces of the casting rolls.

A predetermined program of priorities may be followed when manually or automatically adjusting the control parameters of the casting roll brushes (e.g., speed of rotation and applied force). For example, the rotational speed of the casting roll brushes may be adjusted within given parameters first to induce a reduction in the defect-related effects and, subsequently, the forces applied by the casting roll brushes may be adjusted within given parameters next to further reduce the defect-related effects, if desired. Additional or alternative programmed priorities may be used as desired, in accordance with various embodiments.

The time domain force signals output from the force sensors 261, 262, 271, 272 may comprise analog electrical signals or digital electrical signals as desired. When the time domain force signals are analog electrical signals, analog-to-digital (A/D) converters 235-238 are employed in the subsystem 200 to convert the analog signals to sampled digital time domain signals. The A/D converters 235-238 may be a part of the processor-based platform 230. Alternatively, the A/D converters 235-238 may be external to the processor-based platform 230.

Time domain force signals are generated by the force sensors on the casting roll brushes, similarly to the time domain signals as described above from the force sensors on the casting rolls. The processor-based platform 230 receives the time domain force signals and transforms the time domain force signals to frequency domain spectrums. In accordance with an embodiment, the processor-based platform 230 applies a Fourier transform process (e.g., a Fast Fourier Transform or FFT) to the time domain force signals to generate the frequency domain spectrums. In accordance with alternative embodiments, other transform techniques may be used as desired, e.g., wavelet transformation techniques. Again, only two force sensors (e.g., 261 and 271) may be employed, resulting in two time domain signals and two frequency domain spectrums. Using all four force sensors 261, 271, 262, and 272 is an option providing more data to more accurately identify and correct for defects in the cast strip.

Again, in the resultant frequency domain spectrums, various lower and higher frequency components appear which may be correlated with various types of defects that will occur in the cast steel strip being formed at the nip between the casting rolls. The frequency domain spectrums, and/or composite values derived from the frequency domain spectrums, may be displayed to an operator on the display 240. In this way, an operator may view the frequency domain spectrum and calculated composite levels, and perform real time diagnostics to adjust the rotation speed and applied forces of the casting roll brushes to adjust for defects identified in the cats strip.

Alternatively, the frequency domain spectrums may be automatically analyzed by the processor-based platform 230 to facilitate real time control of at least one of the rotational speed of the casting roll brushes 260 and 270, and the force applied to the casting roll brushes 260 and/or 270 to the casting surfaces of the casting rolls. As part of the analysis process, spectral components within the frequency domain spectrums may be identified. For example, the control signals 282 may be continuously generated, and modified, in response to the analyzed frequency domain spectrums and transmitted to the rotational drives 265 and/or 275 to provide continuous control of rotational speed.

As described previously herein, the frequency domain spectrums are analyzed to identify to calculate composite intensity level for given frequency range. The composite intensity values are continually calculated from the intensity levels of the identified frequency component signals that are present within a selected frequency range. In other words, as the time domain force signals are received and transformed, the composite intensity levels of those spectral components of the frequency domain spectrum within at least one given frequency range are converted to a composite intensity value for a given point in time. Such a process is continued over time to generate a plurality of composite intensity values, which may be plotted as intensity level versus time and displayed on a display to be viewed by an operator. A method of calculating the composite intensity value is as previously described herein (e.g., RMS intensity value).

Any combination or subset of two or four force sensors on the casting rolls or casting roll brushes, or both, may be employed to generate corresponding time domain signals and frequency domain spectrums. Different combinations or subsets of the four sensors and generated time domain signals and frequency domain spectrums may be better at identifying certain types of thin cast strip defects than others, but generally the more data that is provided from different forces sensors the more accurate the identification and correct of defects in the cast strip. For example, referring to FIG. 2, two force sensors 211 and 221 are employed on the first ends of the casting rolls 210 and 220 on the first side of the subsystem 200, and two force sensors 261 and 271 are employed on the first side of the casting roll brushes 260 and 270 on the first side of the subsystem 200. The method 800 of FIG. 8 is carried out (i.e., accomplished) using the four force sensors 211, 221, 261, and 271. The other four force sensors 212, 222, 262, and 272 are not used in this example. Such a configuration may be adequate for identifying low frequency related defects, which may be the only concern for a particular casting campaign. However, in general, all or any subset combination of the eight sensors (211, 212, 221, 222, 261, 262, 271, 272) may be configured and employed (e.g., a first sensor, a second sensor, a third sensor, a fourth sensor, a fifth sensor, a sixth sensor, a seventh sensor, and/or an eighth sensor) to form the corresponding time domain signals and frequency domain spectrums.

Figure 8A:
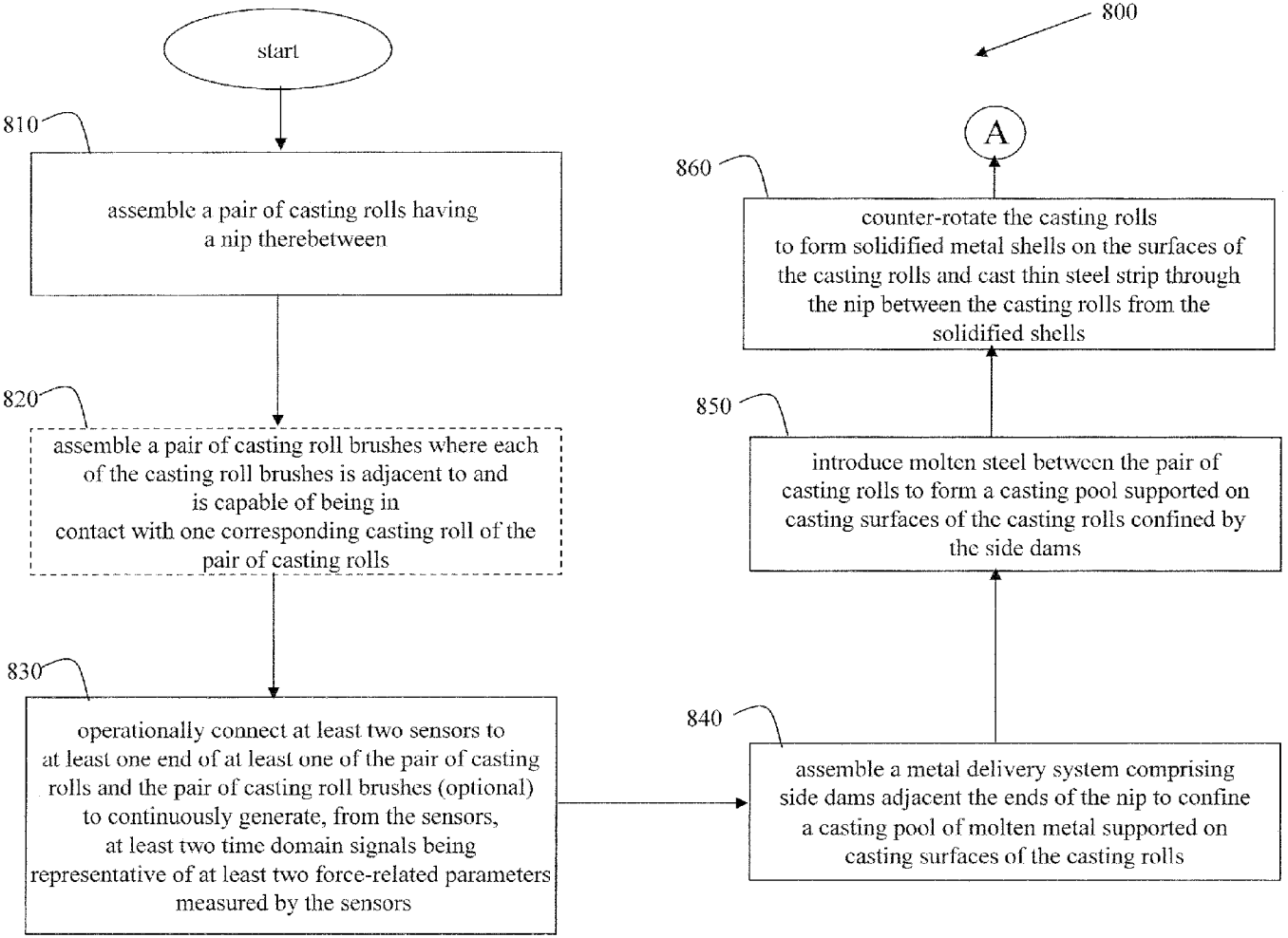
FIGS. 8A-8B illustrate a flowchart of a third embodiment of a method of producing thin cast strip by continuous casting.
Figure 8B:
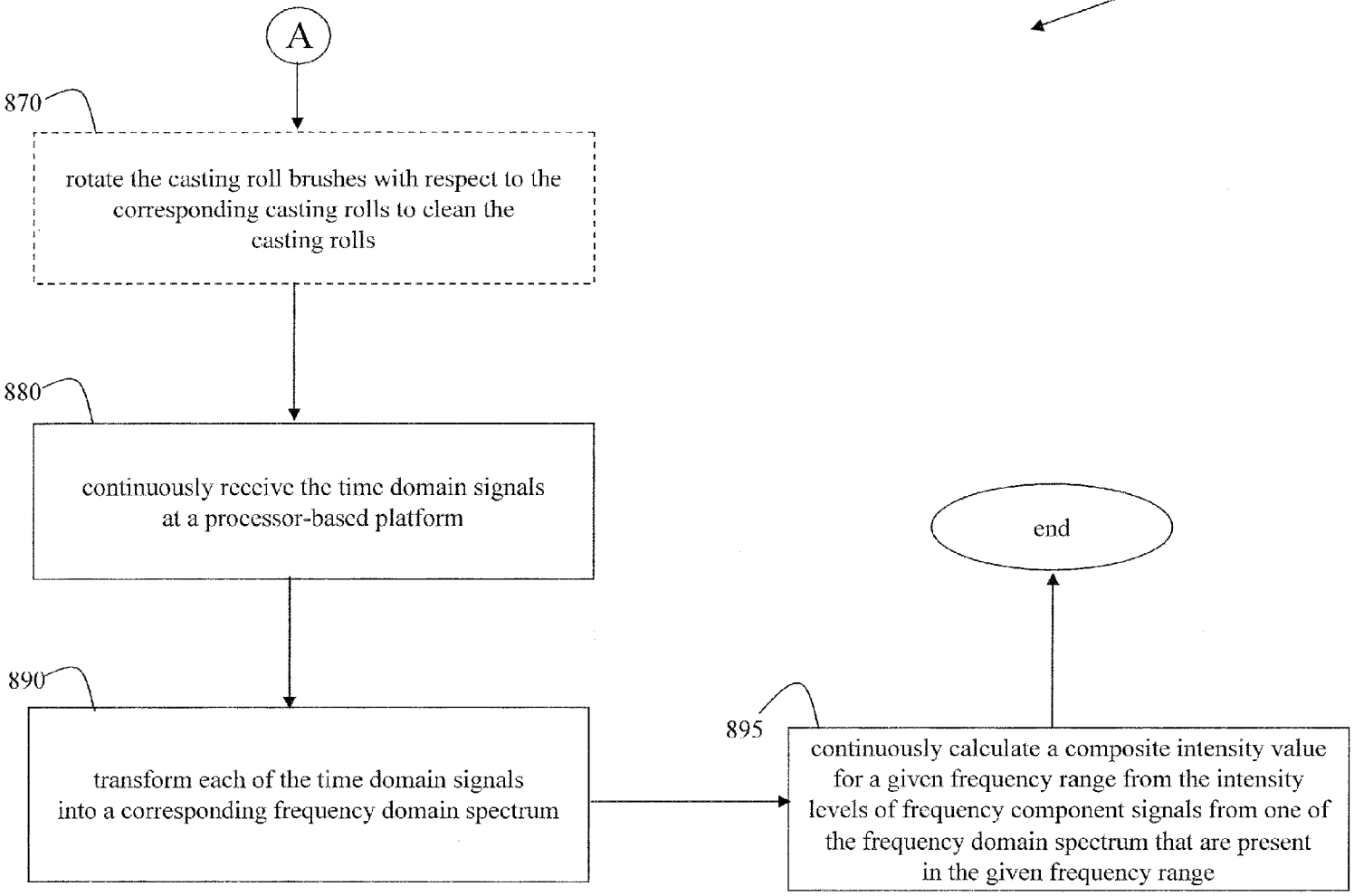

FIGS. 8A-8B illustrate a flowchart of an embodiment of a method 800 of producing thin cast strip by continuous casting. In step 810, a pair of casting rolls is assembled having a nip there between. In step 820, a pair of casting roll brushes is assembled where each of the casting roll brushes is adjacent to and capable of being in contact with one corresponding casting roll of the pair of casting rolls. The casting roll brushes may be optional in particular embodiments of the casting process. In step 830, at least two sensors are operationally connected to at least one end of at least one of the pair of casting rolls and the pair of casting roll brushes (optional) to continuously generate, from the sensors, at least two time domain signals being representative of at least two force-related parameters measured by the sensors.

In step 840, a metal delivery system is assembled comprising side dams adjacent the ends of the nip to confine a casting pool of molten metal supported on casting surfaces of the casting rolls. In step 850, molten steel is introduced between the pair of casting rolls to form a casting pool supported on casting surfaces of the casting rolls confined by the side dams. In step 860, the casting rolls are counter-rotated to form solidified metal shells on the surfaces of the casting rolls and cast thin steel strip through the nip between the casting rolls from the solidified shells.

In step 870, the casting roll brushes may be rotated with respect to the corresponding casting rolls to clean the casting surfaces of the casting rolls. In step 880, the time domain signals are continuously received at a processor-based platform. In step 890, each of the time domain signals are transformed into a corresponding frequency domain spectrum. In step 895, a composite intensity value is continually calculated from the intensity levels of the frequency component signals from at least one of the frequency domain spectrums that are present within a defined frequency range.

The composite intensity values are subsequently used to adjust certain parameters of the twin roll caster system, as previously described herein, to reduce, if not eliminate, the identified causes of the defects in the thin cast strip.

Figure 9:
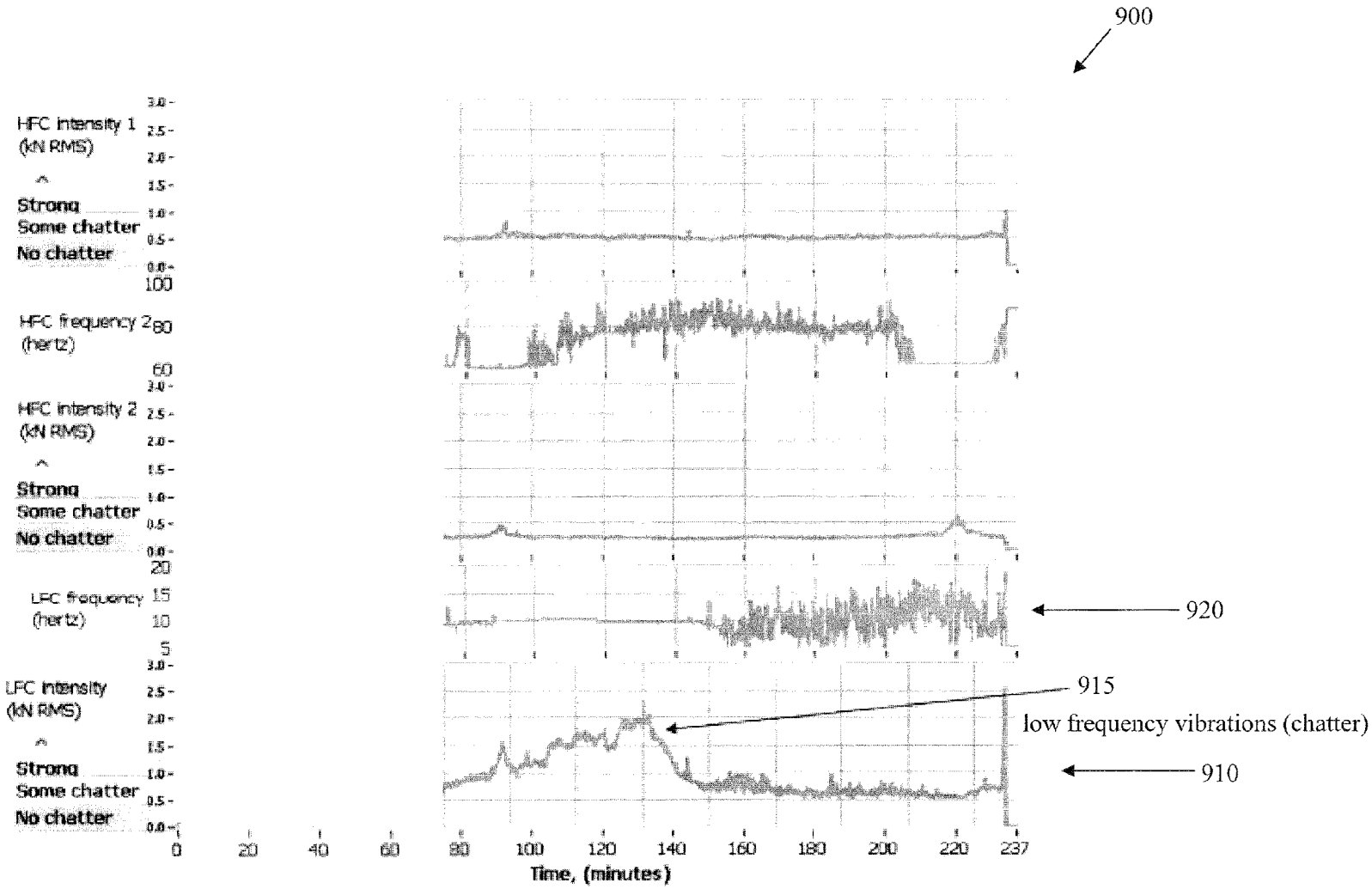
FIG. 9 illustrates an exemplary of a set of graphs or plots showing low frequency vibrations which can result in herring-bone type defects in thin cast metal strip.

FIG. 9 illustrates an exemplary set of graphs or plots 900 showing low frequency vibrations 915 which can result in herring-bone type defects in thin cast metal strip. The low frequency chatter 915 is plotted as RMS intensity versus time in plot 910, The values of the low frequency chatter 915 are derived from the intensity values of the frequency component signals in a range of about 0 to 14 Hz. The corresponding plot 920 of frequency versus time is shown just above the plot 910. The measured forces that resulted in the set of plots 900 were measured at the four-corners of a pair of casting rolls, according to methods previously described herein. As an example, it can be seen in plot 910 at about time 130 minutes that some action was taken (e.g., changing the rotational speed of one of the casting rolls) to reduce the intensity of the low frequency vibrations 915 to avoid herring-bone type defects in the thin cast metal strip.

Figure 10A:
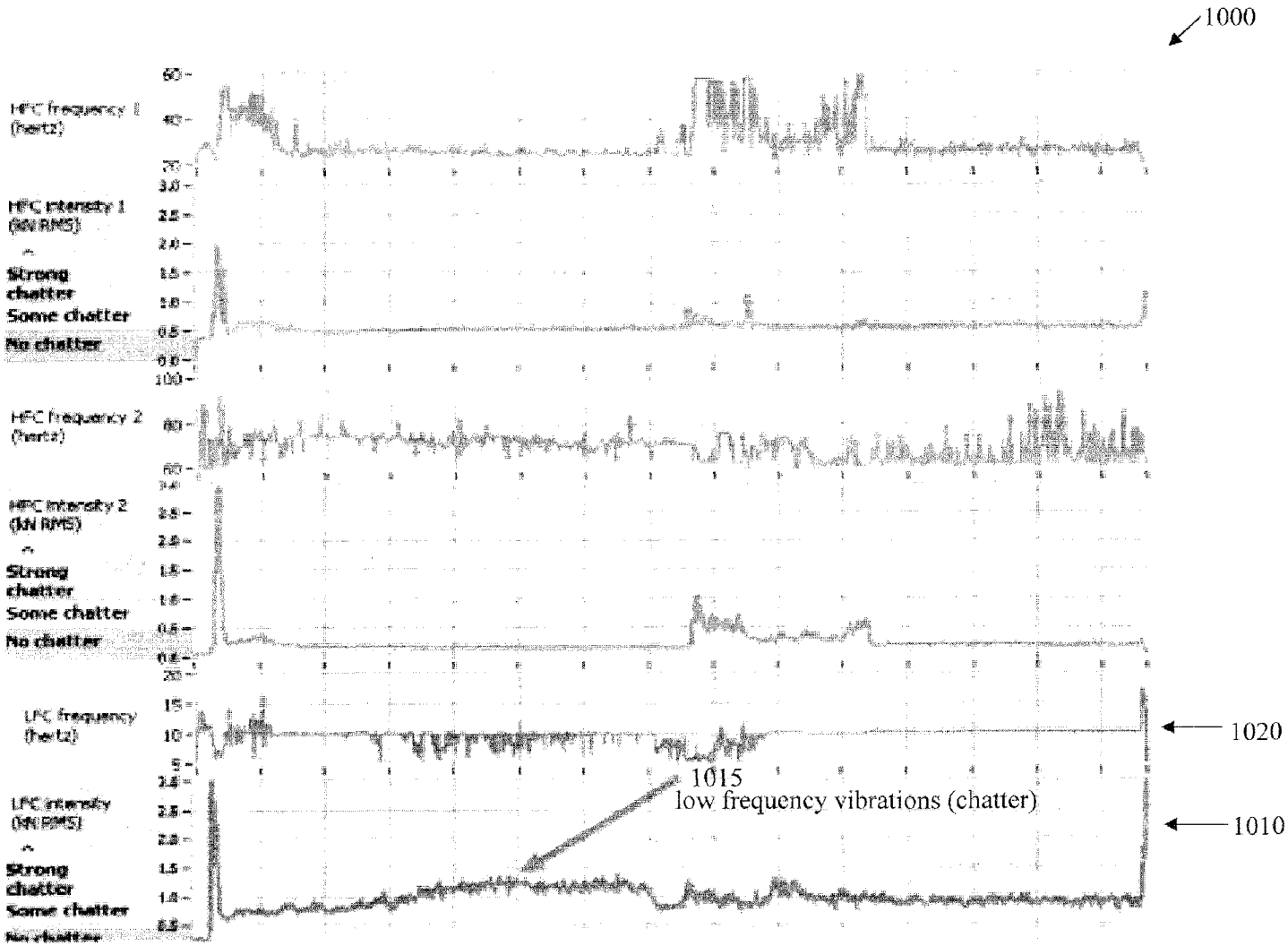
FIGS. 10A-B illustrate exemplary of graphs or plots showing low frequency vibrations which can result in white-line type defects in thin cast metal strip.

FIG. 10A illustrates an exemplary embodiment of a set of graphs or plots 1000 showing low frequency vibrations 1015, which can result in white-line type defects in thin cast metal strip. Similar to FIG. 9, the low frequency chatter 1015 is plotted as RMS intensity versus time in plot 1010. The values of the low frequency chatter 1015 are derived from the intensity values of the frequency component signals in a range of about 0 to 14 Hz. The corresponding plot 1020 of frequency versus time is shown just above the plot 1010. As an example, the gap separation force applied between the casting rolls may be changed to reduce the intensity of the low frequency chatter 1015.

Figure 10B:
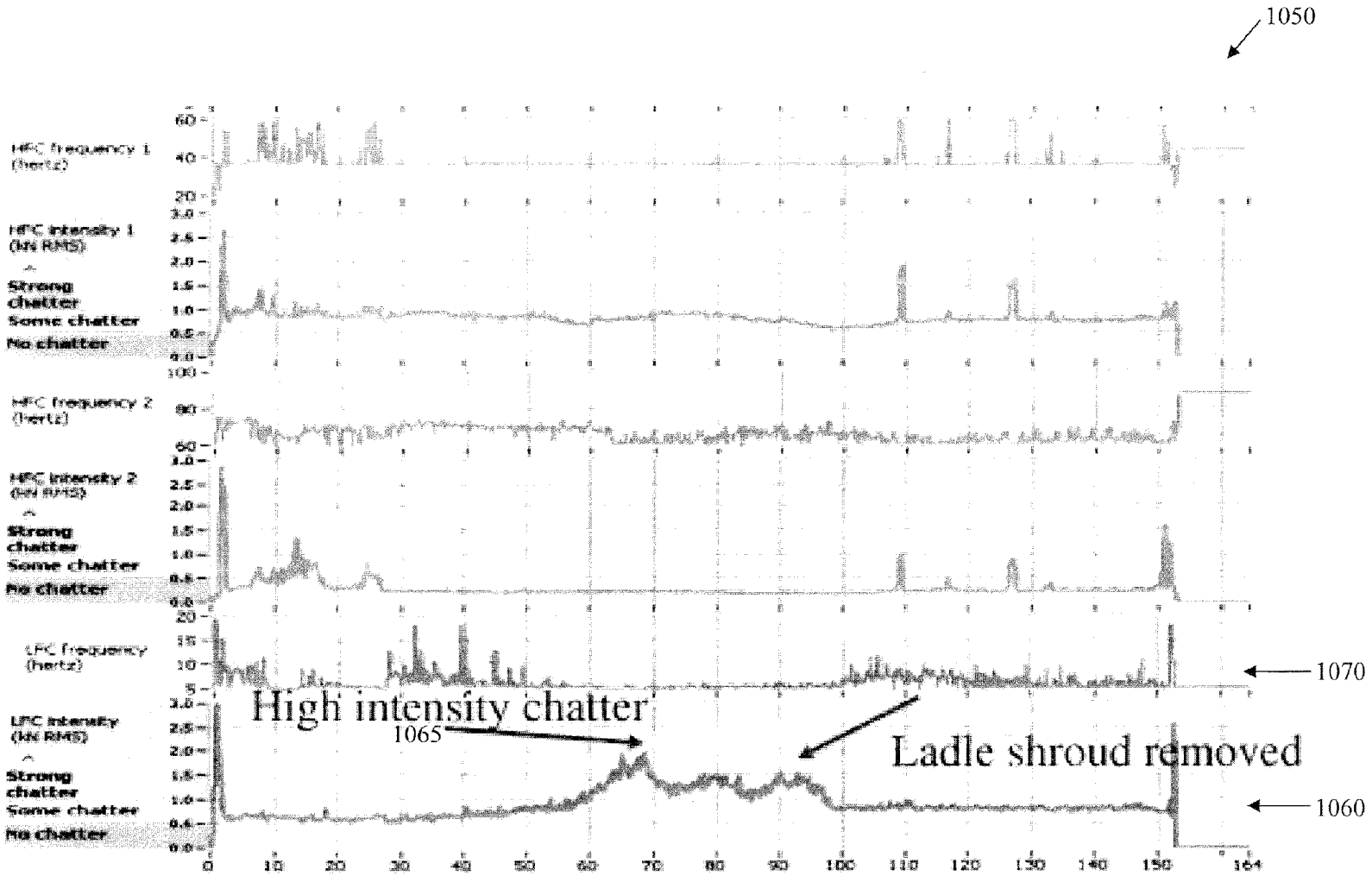

Similarly, FIG. 10B illustrates an exemplary embodiment of a set of graphs or plots 1050 showing low frequency vibrations 1065, which can result in white-line type defects in thin cast metal strip. Again, the low frequency chatter 1065 is plotted as RMS intensity versus time in plot 1060. The values of the low frequency chatter 1065 are derived from the intensity values of the frequency component signals in a range of about 0 to 14 Hz. The corresponding plot 1070 of frequency versus time is shown just above the plot 1060. As an example, the casting pool height was changed to begin to reduce the intensity of the low frequency chatter 1065 at about 70 minutes. Also, a ladle shroud was removed from the casting system to further reduce the low frequency chatter 1065 at about 100 minutes.

Figure 11:
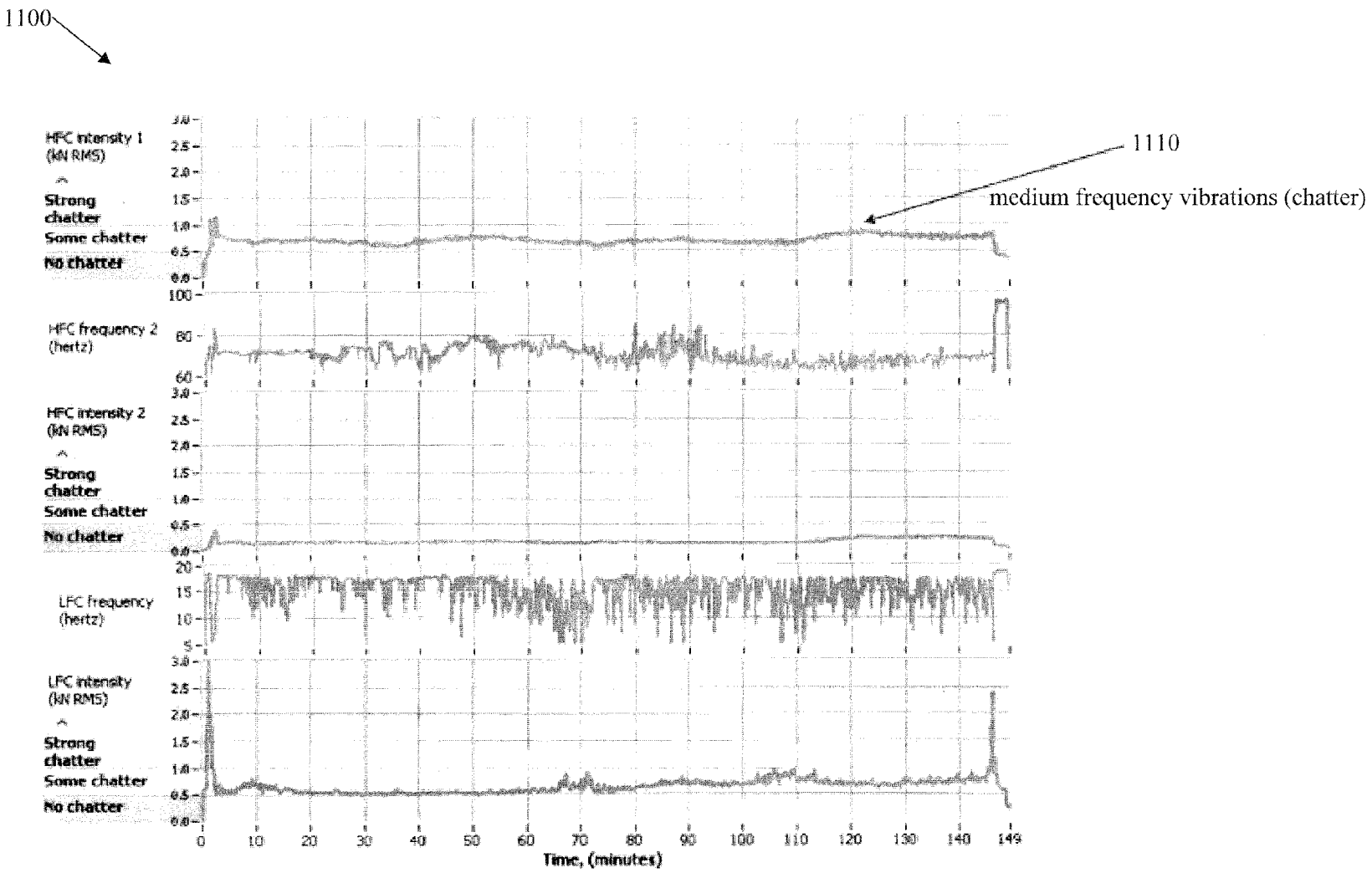
FIG. 11 illustrates an exemplary embodiment of a set of graphs or plots showing medium frequency vibrations which can result in a brush-induced type defects in thin cast metal strip.

FIG. 11 illustrates an exemplary embodiment of a set of graphs or plots 1100 showing medium frequency vibrations 1110 which can result in a brush-induced type defects in thin cast metal strip. The measured forces that resulted in the set of plots 1100 were measured at the four-corners of a pair of casting roll brushes, according to methods previously described herein. As an example, a speed of rotation of one or both of the brushes may be changed, or a force applied by the casting roll brushes against the casting surfaces of the casting rolls may be changed in order to reduce the medium frequency vibrations and, therefore, the brush-induced defects.

Figure 12:
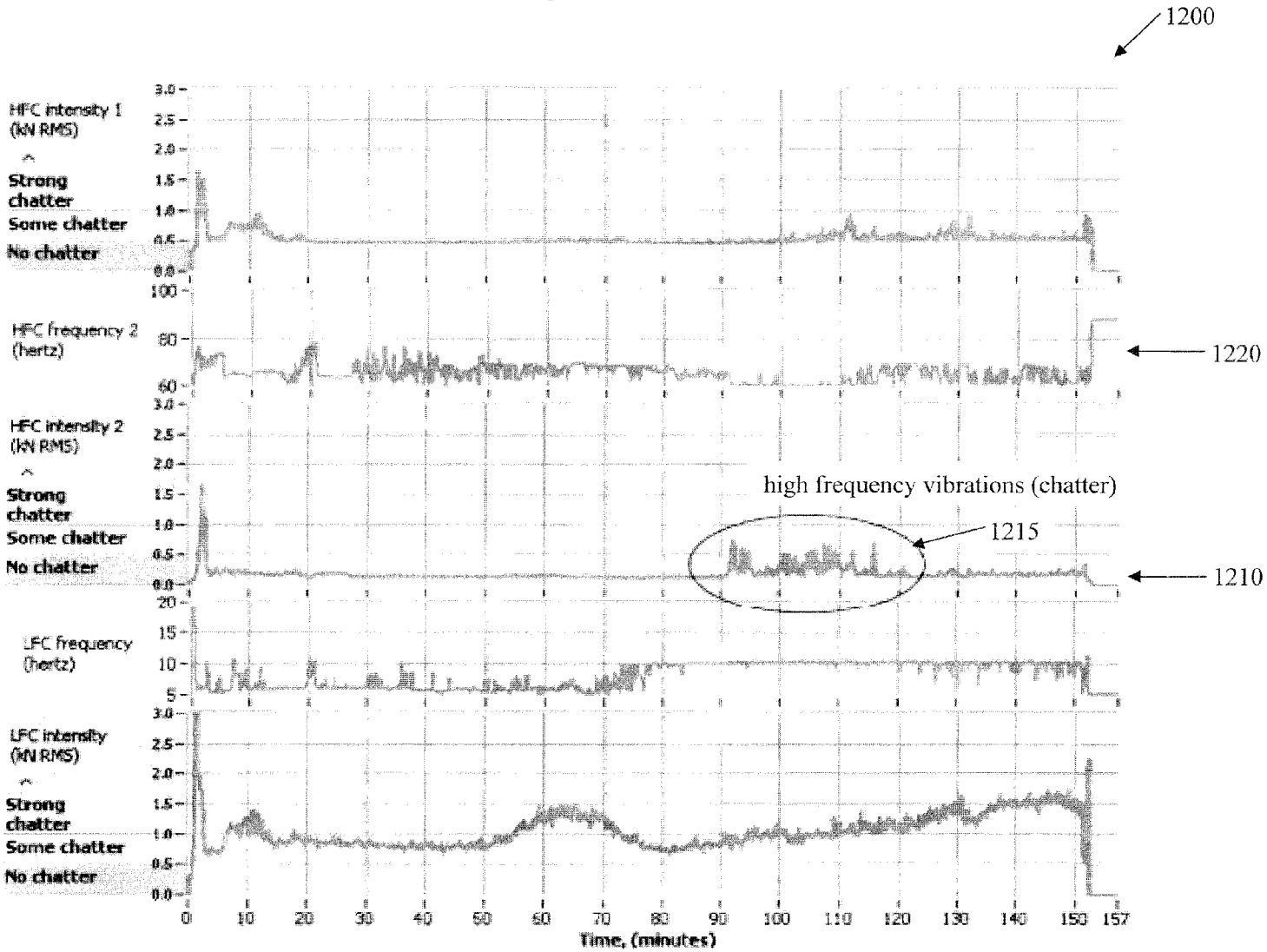
FIG. 12 illustrates an exemplary embodiment of a set of graphs or plots showing high frequency vibrations which can result in high-frequency type defects due uncompensated roll eccentricity or casting pool turbulence.
Figure 13:
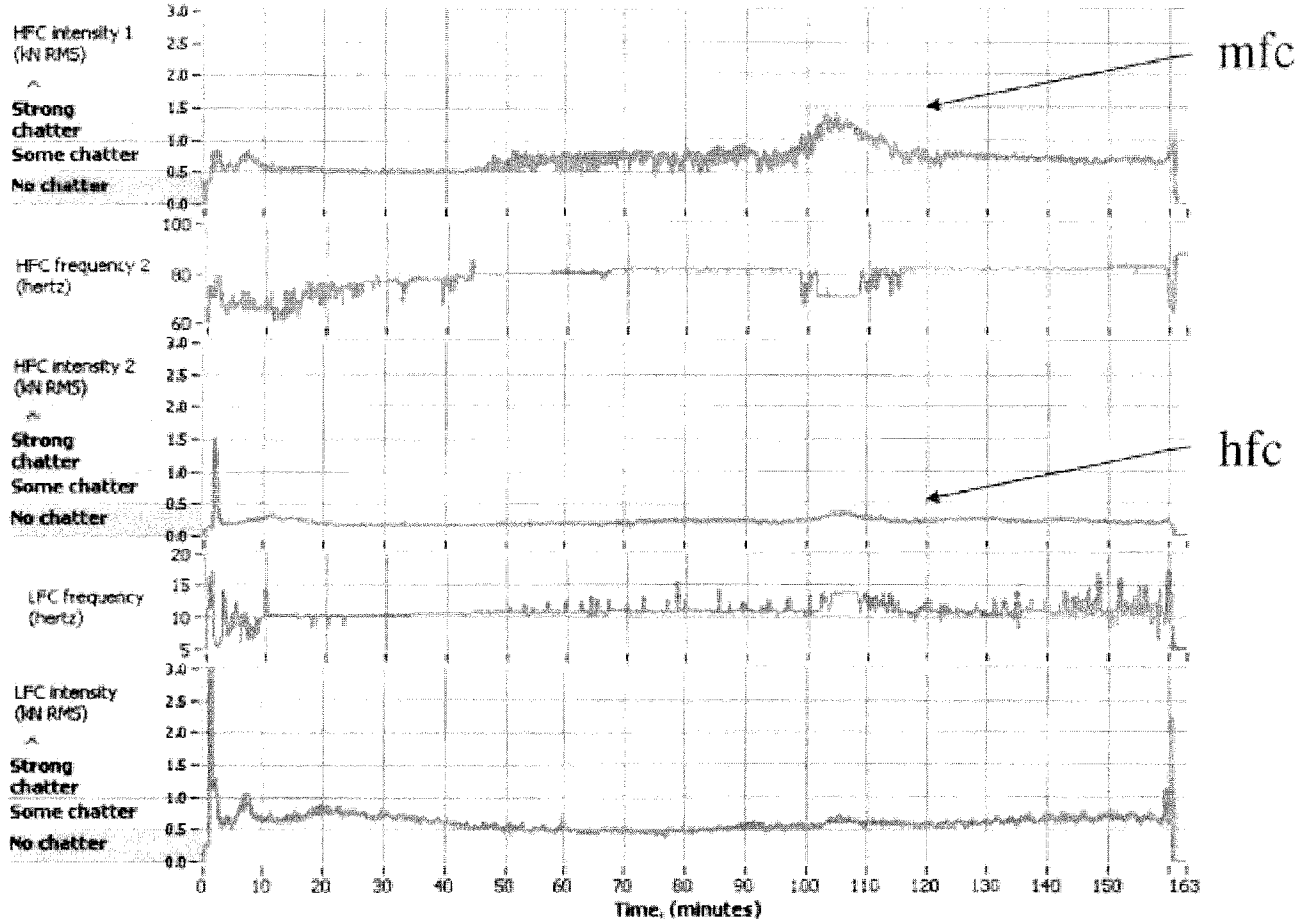
FIGS. 13-16 illustrate exemplary of sets of graphs or plots showing various examples of low frequency chatter (lfc), medium frequency chatter (mfc), and high frequency chatter (hfc), which can cause various types of defects in thin cast steel strip.
Figure 14:
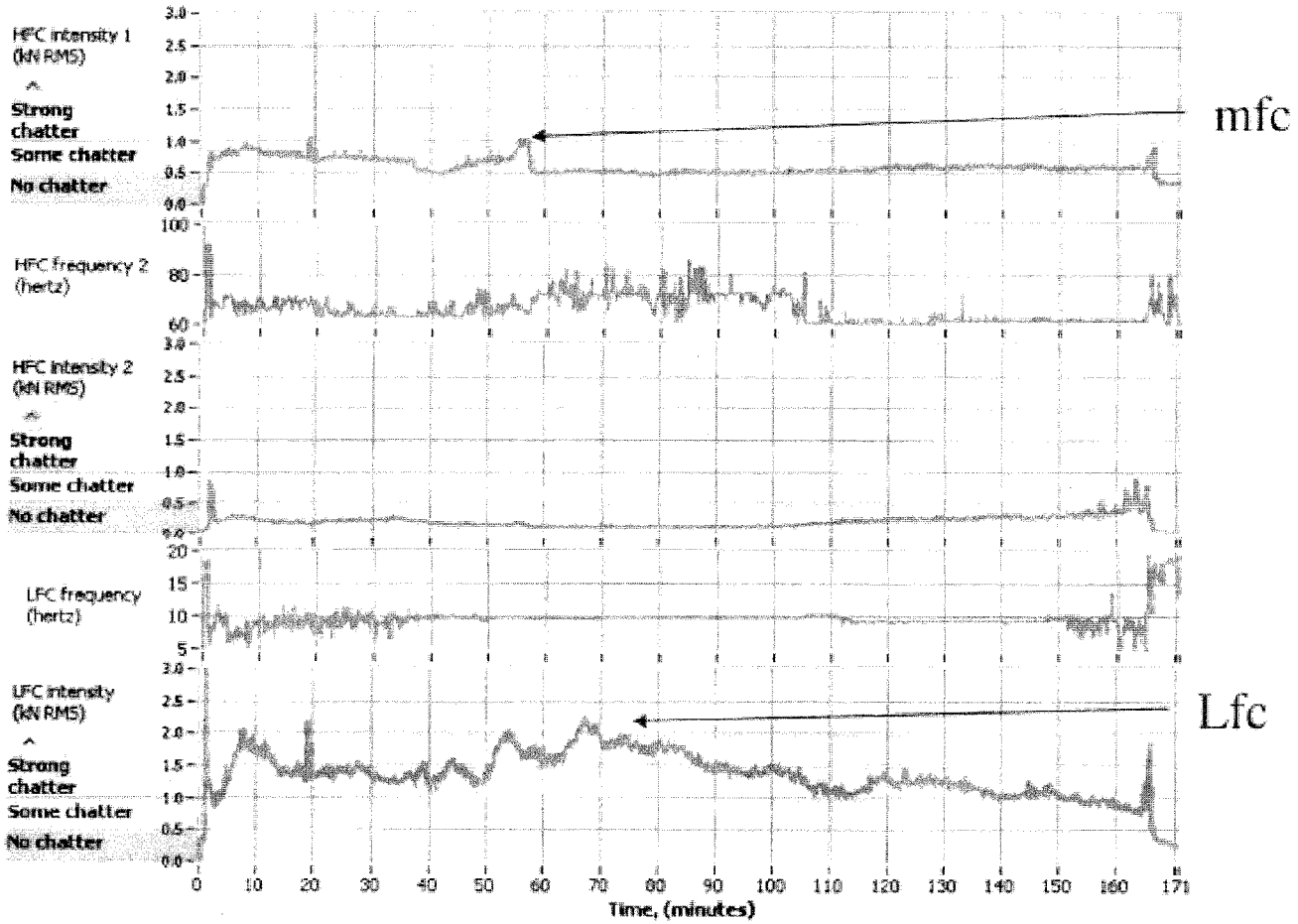
Figure 15:
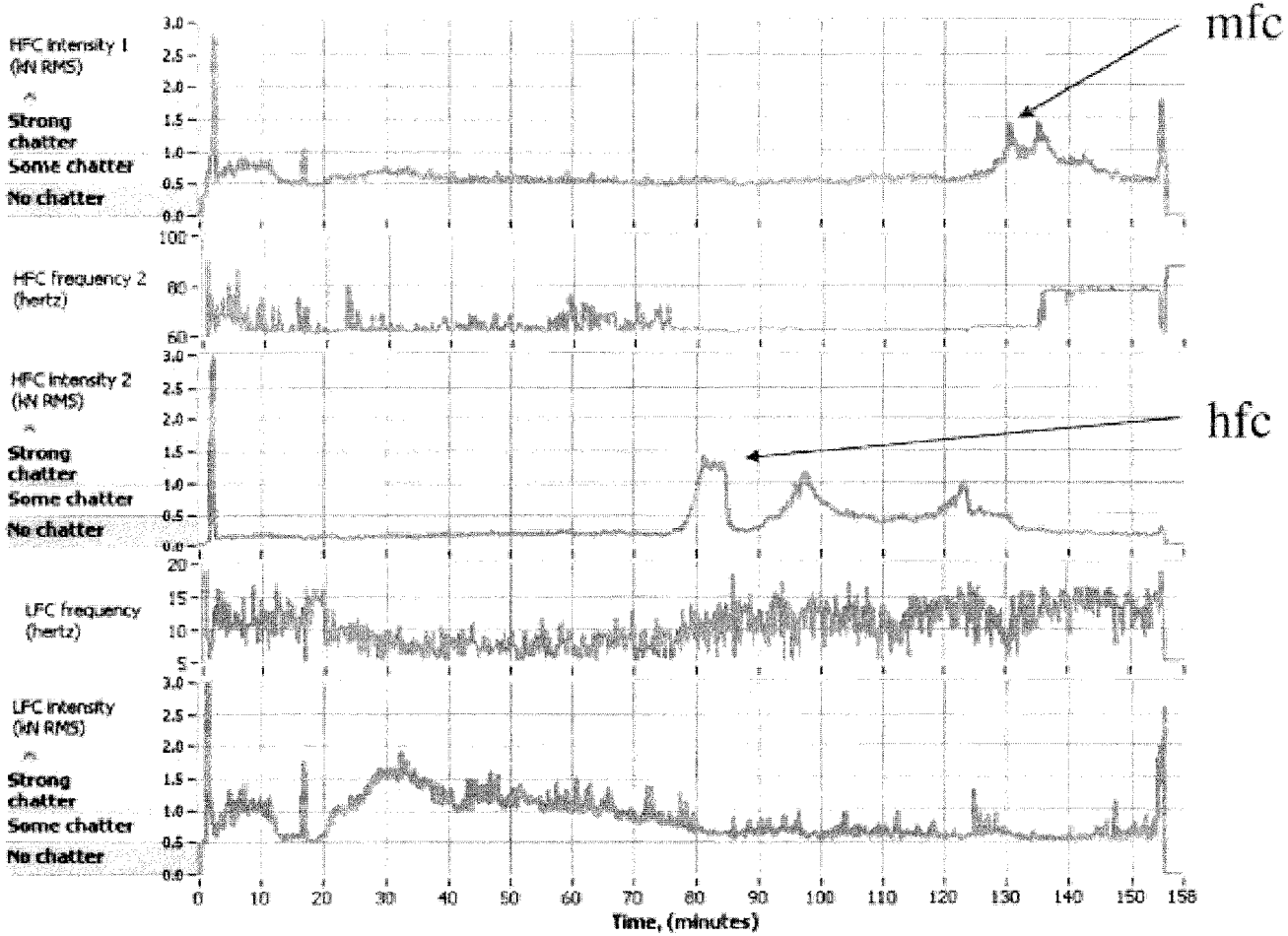
Figure 16:
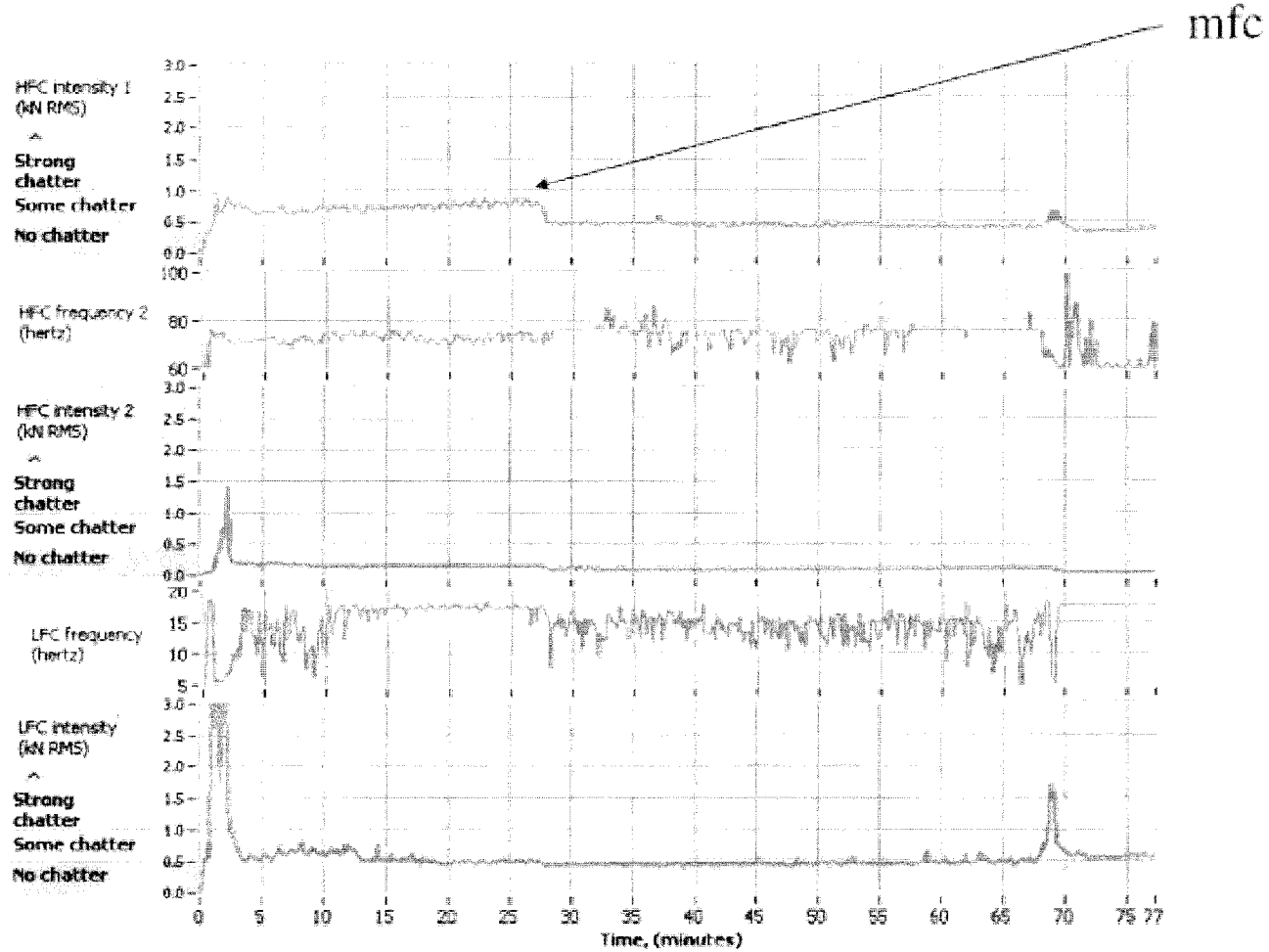

FIG. 12 illustrates an exemplary embodiment of a set of graphs or plots 1200 showing high frequency vibrations 1215, which may result in high-frequency type defects due to uncompensated roll eccentricity and/or casting pool turbulence. The high frequency chatter 1215 is plotted as RMS intensity versus time in plot 1210. The values of the high frequency chatter 1215 are derived from the intensity values of the frequency component signals in a range of about 60 to 100 Hz. The corresponding plot 1220 of frequency versus time is shown just above the plot 1210.

FIGS. 13-16 illustrate exemplary embodiments of sets of graphs or plots showing various examples of low frequency chatter (lfc), medium frequency chatter (mfc), and high frequency chatter (hfc), which can cause various types of defects in thin cast steel strip. The methods and systems described herein may be used to reduce such chatter and the associated defects.

Indicia may be displayed as illustrated in the plots of FIGS. 9-16 to indicate the presence of any of low frequency chatter, medium frequency chatter, high frequency chatter, brush-derived chatter, herring-bone type defect chatter, white-lines type defect chatter, twice-per-roll type defect chatter, or any other type of chatter or defects that may be identified.

In summary, certain embodiments of the present invention provide methods and systems to reduce the causes of variability and defects in thin cast metal strip during a casting process of a continuous twin roll caster system. Forces are continuously measured at a pair of twin caster rolls and/or corresponding brushes, and frequency domain spectrums are generated from the measured forces. Certain spectral components within the frequency domain spectrums correlate to defects being created in the thin cast metal strip. By identifying such spectral components and adjusting certain parameters of the casting process, the causes of the defects may be eliminated or at least reduced.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiments disclosed, but that the invention will include all embodiments falling within the scope of the appended claims.

What is claimed is:

1. A method to reduce the causes of variability and defects in thin cast metal strip during a twin roll casting process comprising:

continuously measuring a first force-related parameter selected from the group consisting of force, strain, acceleration and pressure, at a first end of a first casting roll of a twin roll caster system, and a second force-related parameter selected from the group consisting of force, strain, acceleration and pressure, at said same first end of a second casting roll of said twin roll caster system to form a first time domain signal and a second time domain signal, respectively;

continuously measuring a third force-related parameter selected from the group consisting of force, strain, acceleration and pressure, at an opposite second end of said first casting roll and a fourth force-related parameter selected from the group consisting of force, strain, acceleration and pressure, at said same opposite second end of said second casting roll to form a third time domain signal and a fourth time domain signal, respectively;

transforming said first time domain signal into a first frequency domain spectrum, said second time domain signal into a second frequency domain spectrum, said third time domain signal into a third frequency domain spectrum, and said fourth time domain signal into a fourth frequency domain spectrum; and continually calculating a composite intensity value for a given frequency range from the intensity levels of frequency component signals from one of the frequency domain spectrum that are present in the given frequency range.

2. The method of claim 1 where said composite intensity value is a peak-to-peak value calculated from the intensity levels of said frequency component signals that are present within a predefined frequency range.

3. The method of claim 1 further comprising displaying at least a portion of said frequency component signals in a plot of frequency versus time on a display.

4. The method of claim 3 further comprising displaying said composite intensity value in a plot of intensity level versus time on said display.

5. The method of claim 1 where a predefined frequency range corresponds to a set of lower frequency components in a range of about 0 Hz to 14 Hz.

6. The method of claim 1 where a predefined frequency range corresponds to a set of intermediate frequency components in a range of about 14 Hz to 52 Hz.

7. The method of claim 1 where a predefined frequency range corresponds to a set of higher frequency components in a range above about 52 Hz.

8. The method of claim 4 further comprising displaying, on said display, indicia indicating any presence of high frequency chatter.

9. The method of claim 4 further comprising displaying, on said display, indicia indicating any presence of medium frequency chatter.

10. The method of claim 4 further comprising displaying, on said display, indicia indicating any presence of brush-derived chatter.

11. The method of claim 4 further comprising displaying, on said display, indicia indicating any presence of herring-bone type low frequency chatter.

12. The method of claim 4 further comprising displaying, on said display, indicia indicating any presence of white-lines type low frequency chatter.

13. The method of claim 4 further comprising displaying, on said display, indicia indicating any presence of twice-per-roll type revolution-related force fluctuations.

14. The method of claim 1 further comprising modifying a speed of rotation of at least one of said casting rolls in response to said composite intensity value.

15. The method of claim 1 further comprising modifying a height of a casting pool of said continuous twin roll caster system in response to said composite intensity value.

16. The method of claim 1 further comprising modifying a gap force applied between said casting rolls in response to said composite intensity value.

17. The method of claim 1 where said transforming step is accomplished by applying a Fourier transform process to said time domain signals.

18. The method of claim 17 where said Fourier transform process comprises a fast Fourier transform (FFT) process.

19. The method of claim 1 where said transforming step is accomplished by applying a wavelet transformation process to said time domain signals.

20. The method of claim 1 where said measuring of said first force-related parameter selected from the group consisting of force, strain, acceleration and pressure, is accomplished using a first sensor, said second force-related parameter selected from the group consisting of force, strain, acceleration and pressure, is accomplished using a second sensor, said third force-related parameter selected from the group consisting of force, strain, acceleration and pressure, is accomplished using a third sensor, and said fourth force-related parameter selected from the group consisting of force, strain, acceleration and pressure, is accomplished using a fourth sensor.

21. The method of claim 1 further comprising:

continuously measuring a fifth force-related parameter selected from the group consisting of force, strain, acceleration and pressure, at a first end of a first casting roll brush of said twin roll caster system, and a sixth force-related parameter selected from the group consisting of force, strain, acceleration and pressure, at said same first end of a second casting roll brush of said twin roll caster system to form a fifth time domain signal and a sixth domain signal, respectively;

continuously measuring a seventh force-related parameter selected from the group consisting of force, strain, acceleration and pressure, at an opposite second end of said first casting roll brush and an eighth force-related parameter selected from the group consisting of force, strain, acceleration and pressure, at said same opposite second end of said second casting roll brush to form a seventh time domain signal and an eighth time domain signal, respectively;

transforming said fifth time domain signal into a fifth frequency domain spectrum, said sixth time domain signal into a sixth frequency domain spectrum, said seventh time domain signal into a seventh frequency domain spectrum, and said eighth time domain signal into an eighth frequency domain spectrum; and continually calculating a composite intensity value for a given frequency range from the intensity levels of frequency component signals from one of the frequency domain spectrum that are present in the given frequency range.

22. In a continuous twin roll caster system, a method to reduce the causes of variability and defects in thin cast metal strip during a casting process, said method comprising:

continuously measuring a first force-related parameter selected from the group consisting of force, strain, acceleration and pressure, at a first end of a first casting roll of a twin roll caster system, and a second force-related parameter selected from the group consisting of force, strain, acceleration and pressure, at said same first end of a second casting roll of said twin roll caster system to form a first time domain signal and a second time domain signal, respectively;

transforming said first time domain signal into a first frequency domain spectrum and said second time domain signal into a second frequency domain spectrum; and continually calculating a composite intensity value for a given frequency range from the intensity levels of frequency component signals from one of the frequency domain spectrum that are present in the given frequency range.

23. The method of claim 22 where said composite intensity value is peak-to-peak value calculated from the intensity levels of said frequency component signals that are present within a predefined frequency range.

24. The method of claim 22 further comprising displaying at least a portion of said frequency component signals in a plot of frequency versus time on a display.

25. The method of claim 24 further comprising displaying said composite intensity value in a plot of intensity level versus time on said display.

26. The method of claim 22 where a predefined frequency range corresponds to a set of lower frequency components in a range of about 0 Hz to 14 Hz.

27. The method of claim 22 where a predefined frequency range corresponds to a set of intermediate frequency components in a range of about 14 Hz to 52 Hz.

28. The method of claim 22 where a predefined frequency range corresponds to a set of higher frequency components in a range above about 52 Hz.

29. The method of claim 25 further comprising displaying, on said display, indicia indicating any presence of high frequency chatter.

30. The method of claim 25 further comprising displaying, on said display, indicia indicating any presence of medium frequency chatter.

31. The method of claim 25 further comprising displaying, on said display, indicia indicating any presence of brush-derived chatter.

32. The method of claim 25 further comprising displaying, on said display, indicia indicating any presence of herring-bone type low frequency chatter.

33. The method of claim 25 further comprising displaying, on said display, indicia indicating any presence of white-lines type low frequency chatter.

34. The method of claim 25 further comprising displaying, on said display, indicia indicating any presence of twice-per-roll type revolution-related force fluctuations.

35. The method of claim 25 further comprising modifying a speed of rotation of at least one of said casting rolls in response to said composite intensity value.

36. The method of claim 25 further comprising modifying a height of a casting pool of said continuous twin roll caster system in response to said composite intensity value.

37. The method of claim 25 further comprising modifying a gap force applied between said casting rolls in response to said composite intensity value.

38. The method of claim 22 where said transforming step is accomplished by applying a Fourier transform process to said time domain signals.

39. The method of claim 38 where said Fourier transform process comprises a fast Fourier transform (FFT) process.

40. The method of claim 22 where said transforming step is accomplished by applying a wavelet transformation process to said time domain signals.

41. The method of claim 22 where said measuring of said first force-related parameter selected from the group consisting of force, strain, acceleration and pressure, is accomplished using a first sensor and said measuring of said second force-related parameter selected from the group consisting of force, strain, acceleration and pressure, is accomplished using a second sensor.

42. The method of claim 22 further comprising:

continuously measuring a third force-related parameter selected from the group consisting of force, strain, acceleration and pressure, at a first end of a first casting roll brush of said twin roll caster system, and a fourth force-related parameter selected from the group consisting of force, strain, acceleration and pressure, at said same first end of a second casting roll brush of said twin roll caster system to form a third domain signal and a fourth domain signal, respectively;

transforming said third time domain signal into a third frequency domain spectrum and said fourth time domain signal into a fourth frequency domain spectrum; and continually calculating a composite intensity value for a given frequency range from the intensity levels of frequency component signals from one of the third and fourth frequency domain spectrums that are present in the given frequency range.

43. A method to reduce the causes of variability and defects in thin cast metal strip during a twin roll casting process comprising:

continuously measuring a first force-related parameter selected from the group consisting of force, strain, acceleration and pressure, at a first end of a first casting roll brush of a twin roll caster system, and a second force-related parameter selected from the group consisting of force, strain, acceleration and pressure, at said same first end of a second casting roll brush of said twin roll caster system to form a first time domain signal and a second time domain signal, respectively;

transforming said first time domain signal into a first frequency domain spectrum and said second time domain signal into a second frequency domain spectrum; and continually calculating a composite intensity value for a given frequency range from the intensity levels of frequency component signals from one of the first and second frequency domain spectrum that are present in the given frequency range.

44. The method of claim 43 where said composite intensity value is a root-mean-square value calculated from the intensity levels of said identified frequency component signals that are present within said predefined frequency range.

45. The method of claim 43 further comprising displaying at least a portion of said frequency component signals in a plot of frequency versus time on a display.

46. The method of claim 43 further comprising displaying said composite intensity value in a plot of intensity level versus time on said display.

47. The method of claim 43 where a predefined frequency range corresponds to a set of lower frequency components in a range of about 0 Hz to 20 Hz.

48. The method of claim 43 where a predefined frequency range corresponds to a set of intermediate frequency components in a range of about 14 Hz to 52 Hz.

49. The method of claim 43 where a predefined frequency range corresponds to a set of higher frequency components in a range above about 52 Hz.

50. The method of claim 46 further comprising displaying, on said display, indicia indicating any presence of high frequency chatter.

51. The method of claim 46 further comprising displaying, on said display, indicia indicating any presence of medium frequency chatter.

52. The method of claim 46 further comprising displaying, on said display, indicia indicating any presence of brush-derived chatter.

53. The method of claim 46 further comprising displaying, on said display, indicia indicating any presence of herring-bone type low frequency chatter.

54. The method of claim 46 further comprising displaying, on said display, indicia indicating any presence of white-lines type low frequency chatter.

55. The method of claim 46 further comprising displaying, on said display, indicia indicating any presence of twice-per-roll type revolution-related force fluctuations.

56. The method of claim 43 further comprising modifying a speed of rotation of at least one of said casting roll brushes in response to said composite intensity value.

57. The method of claim 43 further comprising modifying a force applied to at least one of said casting roll brushes in response to said composite intensity value.

58. The method of claim 43 where said transforming step is accomplished by applying a Fourier transform process to said time domain signals.

59. The method of claim 58 where said Fourier transform process comprises a fast Fourier transform (FFT) process.

60. The method of claim 43 where said transforming step is accomplished by applying a wavelet transformation process to said time domain signals.

61. The method of claim 43 where said measuring of said first force-related parameter selected from the group consisting of force, strain, acceleration and pressure, is accomplished using a first sensor and said measuring of said second force-related parameter selected from the group consisting of force, strain, acceleration and pressure, is accomplished using a second sensor.

62. The method of claim 43 further comprising:

continuously measuring a third force-related parameter selected from the group consisting of force, strain, acceleration and pressure, at an opposite second end of said first casting roll brush and a fourth force-related parameter selected from the group consisting of force, strain, acceleration and pressure, at said same opposite second end of said second casting roll brush to form a third time domain signal and a fourth time domain signal, respectively;

transforming said third time domain signal into a third frequency domain spectrum and said fourth time domain signal into a fourth frequency domain spectrum; and continually calculating a composite intensity value for a given frequency range from the intensity levels of frequency component signals from one of the third and fourth frequency domain spectrum that are present in the given frequency range.

63. In a continuous twin roll caster system, a subsystem to reduce the causes of variability and defects in thin cast metal strip during a casting process, said subsystem comprising:

a first sensor operationally connected to a first end of a first casting roll of a twin roll caster system to continuously measure a first force-related parameter selected from the group consisting of force, strain, acceleration and pressure, at said first end of said first casting roll during a casting process;

a second sensor operationally connected to said same first end of a second casting roll of said twin roll caster system to continuously measure a second force-related parameter selected from the group consisting of force, strain, acceleration and pressure, at said first end of said second casting roll during said casting process; and a processor-based platform operationally connected to said first and second sensors to continuously receive one time domain signal from each of said first and second sensors, respectively, and to transform said first and second time domain signals into first and second frequency domain spectrums, respectively, each said first and second spectrums corresponding to said first and second sensors, respectively, and said processor-based platform capable of continually calculating for a given frequency range a composite intensity value from the intensity levels of the frequency component signals within the given frequency range of one of said first and second frequency domain spectrums.

64. The subsystem of claim 63 wherein at least one control signal is modified in response to said composite intensity value, said control signal adapted to adjust at least one of a rotational speed of at least one of said first caster roll and said second caster roll, a casting pool height, and a gap separation force applied between said first caster roll and said second caster roll.

65. The subsystem of claim 63 further comprising:

a third sensor operationally connected to an opposite second end of said first casting roll to continuously measure a third force-related parameter selected from the group consisting of force, strain, acceleration and pressure, at said opposite second end of said first casting roll during said casting process; and a fourth sensor operationally connected to said same opposite second end of said second casting roll to continuously measure a fourth force-related parameter selected from the group consisting of force, strain, acceleration and pressure, at said opposite second end of said second casting roll during said casting process, and where said processor-based platform is operationally connected to said third and fourth sensors to receive one time domain signal from each of said third and fourth sensors, respectively, and to transform said third and fourth time domain signals into third and fourth frequency domain spectrums, respectively, each said third and fourth spectrum corresponding to said third and fourth sensors, respectively, and said processor-based platform capable of continually calculating for at least one given frequency range a composite intensity value from the intensity levels of the frequency component signals within the frequency range from one of said first, second, third and fourth frequency domain spectrums.

66. The subsystem of claim 65 wherein at least one control signal is modified in response to said composite intensity value, said control signal adapted to adjust at least one of a rotational speed of at least one of said first caster roll and said second caster roll, a casting pool height, and a gap force applied between said first caster roll and said second caster roll.

67. The subsystem of claim 65 further comprising:

a fifth sensor operationally connected to a first end of a first casting roll brush of said twin roll caster system to continuously measure a fifth force-related parameter selected from the group consisting of force, strain, acceleration and pressure, at said first end of said first casting roll brush during said casting process; and a sixth sensor operationally connected to said same first end of a second casting roll brush of said twin roll caster system to continuously measure a sixth force-related parameter selected from the group consisting of force, strain, acceleration and pressure, at said second end of said second casting roll brush during said casting process, and where said processor-based platform is operationally connected to said fifth and sixth sensors to receive one time domain signal from each of said fifth and sixth sensors, respectively, and to transform said fifth and sixth time domain signals into fifth and sixth frequency domain spectrums, respectively, each said fifth and sixth spectrum corresponding to said fifth and sixth sensors, respectively, and said processor-based platform capable of continuously calculating said composite intensity value for a given frequency range from the intensity levels of said identified frequency component signals within the given frequency range of said first, second, third, fourth, fifth and sixth frequency domain spectrums.

68. The subsystem of claim 67 wherein at least one control signal is modified in response to said composite intensity value, said control signal adapted to adjust at least one of:

a rotational speed of at least one of said first caster roll, said second caster roll, said first casting roll brush, and said second casting roll brush;

a casting pool height;

a gap force applied between said first caster roll and said second caster roll; and a force applied to at least one of said first casting roll brush and said second casting roll brush.

69. The subsystem of claim 67 further comprising:

a seventh sensor operationally connected to an opposite second end of said first casting roll brush to continuously measure a seventh force-related parameter selected from the group consisting of force, strain, acceleration and pressure, at said opposite second end of said first casting roll brush during said casting process; and an eighth sensor operationally connected to said same opposite second end of said second casting roll brush to continuously measure an eighth force-related parameter selected from the group consisting of force, strain, acceleration and pressure, at said opposite second end of said second casting roll brush during said casting process, and where said processor-based platform is operationally connected to said seventh and eighth sensors to receive one time domain signal from each of said seventh and eighth sensors, respectively, and to transform said seventh and eighth time domain signals into seventh and eighth frequency domain spectrums, respectively, each said seventh and eighth spectrum corresponding to said seventh and eighth sensors, respectively, and said processor-based platform capable of continuously calculating a composite intensity value for a given frequency range from the intensity levels of frequency component signals in the given frequency range from said first, second, third, fourth, fifth and sixth, seventh, and eighth frequency domain spectrums.

70. The subsystem of claim 69 wherein at least one control signal is modified in response to said composite intensity value, said control signal adapted to adjust at least one of:

a rotational speed of at least one of said first caster roll, said second caster roll, said first casting roll brush, and said second casting roll brush;

a casting pool height;

a gap force applied between said first caster roll and said second caster roll; and a force applied to at least one of said first casting roll brush and said second casting roll brush.

71. The subsystem of claim 69 where at least one of said sensors comprises a load cell.

72. The subsystem of claim 69 where at least one of said sensors comprises a strain gauge.

73. The subsystem of claim 69 where said time domain signals are analog electrical signals.

74. The subsystem of claim 69 where said time domain signals are digital electrical signals.

75. The subsystem of claim 73 where said processor-based platform includes at least one analog-to-digital converter to convert each corresponding said analog time domain signal into a digital time domain signal.

76. The subsystem of claim 63 further comprising a display operationally connected to said processor-based platform to display at least one of a frequency versus time plot, and a composite intensity value versus time plot, said plots being derived from at least one of said frequency domain spectrums.

77. The subsystem of claim 64 further comprising a user interface operationally connected to said processor-based platform to allow a user to at least modify said control signal.

78. The subsystem of claim 63 where said composite intensity value is a root-mean-square value calculated from the intensity levels of at least said portion of said identified frequency component signals.

79. The subsystem of claim 69 further comprising a display operationally connected to said processor-based platform to display at least one of a frequency versus time plot, and a composite intensity value versus time plot, said plots being derived from at least one of said frequency domain spectrums.

80. The subsystem of claim 70 further comprising a user interface operationally connected to said processor-based platform to allow a user to at least modify said control signal.

81. A method of producing thin cast strip by continuous casting comprising the steps of:

a) assembling a pair of casting rolls having a nip therebetween;

b) operationally connecting at least two sensors to at least one end of said pair of casting rolls to continuously generate, from the sensors, at least two time domain signals being representative of at least two force-related parameters selected from the group consisting of force, strain, acceleration and pressure, measured by said sensors;

c) assembling a metal delivery system comprising side dams adjacent the ends of the nip to confine a casting pool of molten metal supported on casting surfaces of the casting rolls;

d) introducing molten steel between the pair of casting rolls to form a casting pool supported on casting surfaces of the casting rolls confined by the side dams;

e) counter-rotating the casting rolls to form solidified metal shells on the surfaces of the casting rolls and cast thin steel strip through the nip between the casting rolls from the solidified shells;

f) continuously receiving said time domain signals at a processor-based platform;

g) transforming each of said time domain signals into a corresponding frequency domain spectrum; and h) continually calculating a composite intensity value for a given frequency range from the intensity levels of frequency component signals from one of the frequency domain spectrum that are present in the given frequency range.

82. The method of claim 81 where said composite intensity value is a root-mean-square value calculated from the intensity levels of said identified frequency component signals that are present within a predefined frequency range.

83. The method of claim 81 further comprising displaying at least a portion of said frequency component signals in a plot of frequency versus time on a display.

84. The method of claim 83 further comprising displaying said composite intensity value in a plot of intensity level versus time on said display.

85. The method of claim 84 further comprising adjusting a speed of rotation of at least one of said pair of casting rolls in response to viewing said plot of composite intensity value on said display in order to eliminate or at least reduce a cause of at least one casting defect in said thin cast strip.

86. The method of claim 84 further comprising adjusting a casting pool height in response to viewing said plot of composite intensity value on said display in order to eliminate or at least reduce a cause of at least one casting defect in said thin cast strip.

87. The method of claim 84 further comprising adjusting a gap force applied between said pair of casting rolls in response to viewing said plot of composite intensity value on said display in order to eliminate or at least reduce a cause of at least one casting defect in said thin cast strip.

88. A method of producing thin cast strip by continuous casting comprising the steps of:

a) assembling a pair of casting rolls having a nip therebetween;

b) assembling a pair of casting roll brushes where each one of said casting roll brushes is adjacent to and capable of being in contact with one corresponding casting roll of said pair of casting rolls;

c) operationally connecting at least two sensors to at least one end and of at least one of said pair of casting rolls and said pair of said casting roll brushes to continuously generate, from the sensors, at least two time domain signals being representative of at least two force-related parameters selected from the group consisting of force, strain, acceleration and pressure, measured by said sensors;

d) assembling a metal delivery system comprising side dams adjacent the ends of the nip to confine a casting pool of molten metal supported on casting surfaces of the casting rolls;

e) introducing molten steel between the pair of casting rolls to form a casting pool supported on casting surfaces of the casting rolls confined by the side dams;

f) counter-rotating the casting rolls to form solidified metal shells on the surfaces of the casting rolls and cast thin steel strip through the nip between the casting rolls from the solidified shells;

g) rotating said casting roll brushes with respect to said corresponding casting rolls to clean said casting rolls;

h) continuously receiving said time domain signals at a processor-based platform;

i) transforming each of said time domain signals into a corresponding frequency domain spectrum; and j) continually calculating a composite intensity value for a given frequency range from the intensity levels of frequency component signals from one of the frequency domain spectrum that are present in the given frequency range.

89. The method of claim 88 where said composite intensity value is a root-mean-square value calculated from the intensity levels of said frequency component signals that are present within said given frequency range.

90. The method of claim 88 further comprising displaying at least a portion of said frequency component signals in a plot of frequency versus time on a display.

91. The method of claim 90 further comprising displaying said composite intensity value in a plot of intensity level versus time on said display.

92. The method of claim 91 further comprising adjusting a speed of rotation of at least one of said pair of casting rolls in response to viewing said plot of composite intensity value on said display in order to eliminate or at least reduce a cause of at least one casting defect in said thin cast strip.

93. The method of claim 91 further comprising adjusting a speed of rotation of at least one of said pair of casting roll brushes in response to viewing said plot of composite intensity value on said display in order to eliminate or at least reduce a cause of at least one casting defect in said thin cast strip.

94. The method of claim 91 further comprising adjusting a casting pool height in response to viewing said plot of composite intensity value on said display in order to eliminate or at least reduce a cause of at least one casting defect in said thin cast strip.

95. The method of claim 91 further comprising adjusting a gap force applied between said pair of casting rolls in response to viewing said plot of composite intensity value on said display in order to eliminate or at least reduce a cause of at least one casting defect in said thin cast strip.

96. The method of claim 91 further comprising adjusting a force applied to at least one of said pair of casting roll brushes in response to viewing said plot of composite intensity value on said display in order to eliminate or at least reduce a cause of at least one casting defect in said thin cast strip.

97. The subsystem of claim 69 where at least one of said sensors comprises an accelerometer.

98. The subsystem of claim 69 where at least one of said sensors comprises a gauge that measures delta pressure on a hydraulic cylinder.

99. The method of claim 43 where said composite intensity value is a root-sum-square value calculated from the intensity levels of said frequency component signals that are present within a predefined frequency range.

100. The subsystem of claim 63 where said composite intensity value is a root-sum-square value calculated from the intensity levels of at least said portion of said frequency component signals.

101. The method of claim 81 where said composite intensity value is a root-sum-square value calculated from the intensity levels of said frequency component signals that are present within a predefined frequency range.

102. The method of claim 88 where said composite intensity value is a root-sum-square value calculated from the intensity levels of said frequency component signals that are present within said given frequency range.

* * * * *

UNITED STATES PATENT AND TRADEMARK OFFICE

CERTIFICATE OF CORRECTION

PATENT NO. : 7,650,925 B2
APPLICATION NO. : 11/467652
DATED : January 26, 2010
INVENTOR(S) : Nikolovski et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 666 days.

Signed and Sealed this

Twenty-third Day of November, 2010

David J. Kappos

David J. Kappos
*Director of the United States Patent and Trademark Office*